US010148009B2

(12) United States Patent
Klemes

(10) Patent No.: US 10,148,009 B2
(45) Date of Patent: Dec. 4, 2018

(54) SPARSE PHASE-MODE PLANAR FEED FOR CIRCULAR ARRAYS

(71) Applicant: Marek Klemes, Kanata (CA)

(72) Inventor: Marek Klemes, Kanata (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 442 days.

(21) Appl. No.: 14/948,879

(22) Filed: Nov. 23, 2015

(65) Prior Publication Data

US 2017/0149134 A1 May 25, 2017

(51) Int. Cl.

*H01Q 3/40* (2006.01)
*H01Q 21/00* (2006.01)
*H01Q 21/20* (2006.01)

(52) U.S. Cl.

CPC ..... *H01Q 3/40* (2013.01); *H01Q 21/0012* (2013.01); *H01Q 21/0031* (2013.01); *H01Q 21/20* (2013.01)

(58) Field of Classification Search

CPC .. H01Q 3/40; H01Q 21/0012; H01Q 21/0031; H01Q 21/20

See application file for complete search history.

(56) References Cited

U.S. PATENT DOCUMENTS 3,827,055 A * 7/1974 Bogner ..... H01Q 21/0012 342/376
5,325,101 A * 6/1994 Rudish ..... H01Q 3/40 342/372
9,413,067 B2 8/2016 Klemes
2004/0257292 A1 12/2004 Wang
2006/0114158 A1* 6/2006 Chiang ..... H01Q 3/40 342/424
2013/0234890 A1 9/2013 Chethik et al.

(Continued)

FOREIGN PATENT DOCUMENTS

WO 2015040500 A2 3/2015

OTHER PUBLICATIONS

Karavassilis et al., IEE Proceedings, vol. 133. Pt. H. No. 2, Apr. 1986, pp. 147-154.

(Continued)

*Primary Examiner* — Bernarr E Gregory
*Assistant Examiner* — Fred H Mull

(57) ABSTRACT

A method and apparatus for phase-mode feeding a circular antenna array for beamsteering is provided. A Butler Matrix having M antenna-side ports and M input/output ports is coupled to beamsteering circuitry. The coupled input/output ports may include a port corresponding to a phase-mode having an order magnitude greater than one. The coupled input/output ports may include ports of three different order magnitudes of phase-mode. The Butler Matrix is coupled to M inner ports of a radial waveguide, and the antenna elements are coupled to N outer ports of the waveguide, where N>M. Where M=4, the input/output ports correspond to a zeroth order phase-mode, plus and minus $1^{st}$ order phase-modes, and a second order phase-mode. The zeroth order phase-mode may be used for beamsteering closer to the radial axis of the antenna array while the second order phase-mode may be used for beamsteering further from the radial axis.

30 Claims, 15 Drawing Sheets

(56) References Cited

U.S. PATENT DOCUMENTS

| | | | | |
|---|---|---|---|---|
| 2013/0290556 | A1 | 10/2013 | Giladi | |
| 2013/0321207 | A1* | 12/2013 | Monogioudis | H01Q 3/40 342/373 |
| 2014/0266901 | A1 | 9/2014 | Klemes | |
| 2015/0341098 | A1* | 11/2015 | Angeletti | H01Q 3/40 375/267 |
| 2015/0349422 | A1 | 12/2015 | Klemes | |
| 2016/0315386 | A1 | 10/2016 | Klemes | |

OTHER PUBLICATIONS

Davis, J. G. and Gibson, A. A.: "Phase Mode Excitation in Beamforming Arrays", pp. 307-310, Proceedings of the 3rd European Radar Conference, Manchester, UK, Sep. 2006.

Rahim, T. and Davies, D.E.N., "Effect of directional elements on the directional response of circular antenna arrays", IEE Proceedings, Part H, vol. 129, No. 1, Feb. 1982.

Akiyama A., Hirokawa, J., Ando, J., Takeda , E. and Arai, Y.: "Characteristics of 60GHz Band Conical Beam Radial Line Slot Antennas", IEEE International Symposium on Antennas and Propagation, pp. 2122-2125, 1999.

Sibille, A., Roblin, C., Poncelet G., "Beam steering circular monopole arrays for wireless applications", IEE Antennas and Propagation, International Conference on, vol. 1, Apr. 14-17, 1997 pp. 358-361.

Shemiraniani M. B. and Aryanfar F. "Analog implementation of high resolution DFT in RF domain, utilizing a special multilayer realization of Rotman lens", IEEE Antennas and Propagation, 2008.

Mailloux R. J. : Phased Array Antenna Handbook, Second Edition, Artech House, Boston, © Mar. 31, 2005, chapter 7, pp. 353-378.

Mohamadi, F. Microwave/Millimeter Wave Technology, "Wafer-scale integration brings low cost and a small footprint to active antenna arrays", RF Design, Feb. 2005.

Pasupathy S. and Venetsanopoulos, A. N. "Optimum Active Array Structure and Space-Time Factorability", IEEE Transactions on Aerospace and Electronic Systems, vol. AES-10, No. 6, Nov. 1974.

Blanais, Constantine, Modern Antenna Handbook, edited by Constantine A. Balanis, John Wiley & Sons, Aug. 2008, ISBN: 978-0-470-03634-1, chapter 15, pp. 737-777.

* cited by examiner

SPARSE PHASE-MODE PLANAR FEED FOR CIRCULAR ARRAYS

FIELD OF THE INVENTION

The present invention pertains to the field of antenna arrays and in particular to a method and apparatus for feeding antenna arrays in support of beamsteering.

BACKGROUND

Beamsteering is the angular positioning of the main lobe of a radiation pattern. This allows for greater discrimination in favor of a desired signal from a point-like source in the far field of the antenna, for sensing or information transmission and reception. When it is required to steer the beam of a planar array antenna over a limited range in two dimensions around an array axis which is perpendicular to the plane of the array, it becomes difficult to fit each element with a variable phase shifter or transceiver module, and incorporate the elements into the feed structure as would be devised in the conventional approach. This is especially true where the wavelengths involved are small, because the array elements and spacings scale with wavelength (must be in the order of half wavelength) whereas feed lines and phase shifters take up additional room and do not completely scale with wavelength, especially transceiver modules. As such, the phase shifters and transceiver modules become expensive for short wavelengths, e.g. millimeter-waves, so it is desirable to use as few of them as possible to achieve the desired beam control.

Therefore there is a need for a method and apparatus for feeding a circular antenna array, that obviates or mitigates one or more limitations of the prior art.

This background information is provided to reveal information believed by the applicant to be of possible relevance to the present invention. No admission is necessarily intended, nor should be construed, that any of the preceding information constitutes prior art against the present invention.

SUMMARY

An object of embodiments of the present invention is to provide a method and apparatus for sparsely phase-mode feeding a circular antenna array. In accordance with embodiments of the present invention, there is provided an apparatus for feeding an array of antenna elements, comprising: a Butler Matrix comprising a plurality of M antenna-side ports and a plurality of M input/output ports operatively coupled to the M antenna-side ports, the plurality of input/output ports including a first port corresponding to a phase-mode having an order magnitude greater than one, at least the first port and one additional one of the plurality of input/output ports configured for operative coupling to beamsteering circuitry; and a feed for the array of antenna elements comprising: a radial waveguide forming a cylindrical cavity bounded by conductive material; a plurality of N antenna-element probes symmetrically arranged about an axial center of the radial waveguide, the plurality of antenna-element probes operatively coupled to the radial waveguide; and a plurality of M phase-mode feed probes symmetrically arranged about the axial center of the radial waveguide and disposed radially inward from the plurality of antenna-element probes, the plurality of phase-mode feed probes operatively coupled to the radial waveguide, a quantity M of the phase-mode feed probes being less than a quantity N of the antenna-element probes, the plurality of M phase-mode feed probes being operatively coupled to the M antenna-side ports of the Butler Matrix, each of the N antenna-element probes for operative coupling to a respective antenna element of the array.

In accordance with embodiments of the present invention, there is provided a method for sparse phase-mode feeding of an array of antenna elements, the method comprising: providing a Butler Matrix comprising a plurality of M antenna-side ports and a plurality of M input/output ports operatively coupled to the M antenna-side ports, the plurality of input/output ports including a first port corresponding to a phase-mode having an order magnitude greater than one, at least the first port and one additional one of the plurality of input/output ports configured for operative coupling to beamsteering circuitry; providing a feed for the array of antenna elements comprising: a radial waveguide forming a cylindrical cavity bounded by conductive material; a plurality of N antenna-element probes symmetrically arranged about an axial center of the radial waveguide, the plurality of antenna-element probes operatively coupled to the radial waveguide; and a plurality of M phase-mode feed probes symmetrically arranged about the axial center of the radial waveguide and disposed radially inward from the plurality of antenna-element probes, the plurality of phase-mode feed probes operatively coupled to the radial waveguide, a quantity M of the phase-mode feed probes being less than a quantity N of the antenna-element probes, operatively coupling at least the first port and the one additional one of the plurality of input/output ports to beamsteering circuitry; operatively coupling the M antenna-side ports of the Butler Matrix to the plurality of M phase-mode feed probes; and operatively coupling the N antenna-element probes to respective antenna elements of the array.

In accordance with embodiments of the present invention, there is provided a wireless device comprising: an array of antenna elements; a transmitter/receiver comprising: a source or destination for wireless signals; beamsteering circuitry operatively coupled to the source or destination for wireless signals; a Butler Matrix comprising a plurality of M antenna-side ports and a plurality of M input/output ports operatively coupled to the M antenna-side ports, the plurality of input/output ports including a first port corresponding to a phase-mode having an order magnitude greater than one, at least the first port and one additional one of the plurality of input/output ports configured for operative coupling to the beamsteering circuitry; and a feed for the array of antenna elements comprising: a radial waveguide forming a cylindrical cavity bounded by conductive material; a plurality of N antenna-element probes symmetrically arranged about an axial center of the radial waveguide, the plurality of antenna-element probes operatively coupled to the radial waveguide; and a plurality of M phase-mode feed probes symmetrically arranged about the axial center of the radial waveguide and disposed radially inward from the plurality of antenna-element probes, the plurality of phase-mode feed probes operatively coupled to the radial waveguide, a quantity M of the phase-mode feed probes being less than a quantity N of the antenna-element probes, the plurality of M phase-mode feed probes being operatively coupled to the M antenna-side ports of the Butler Matrix, each of the N antenna-element probes for operative coupling to a respective antenna element of the array.

BRIEF DESCRIPTION OF THE FIGURES

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1:
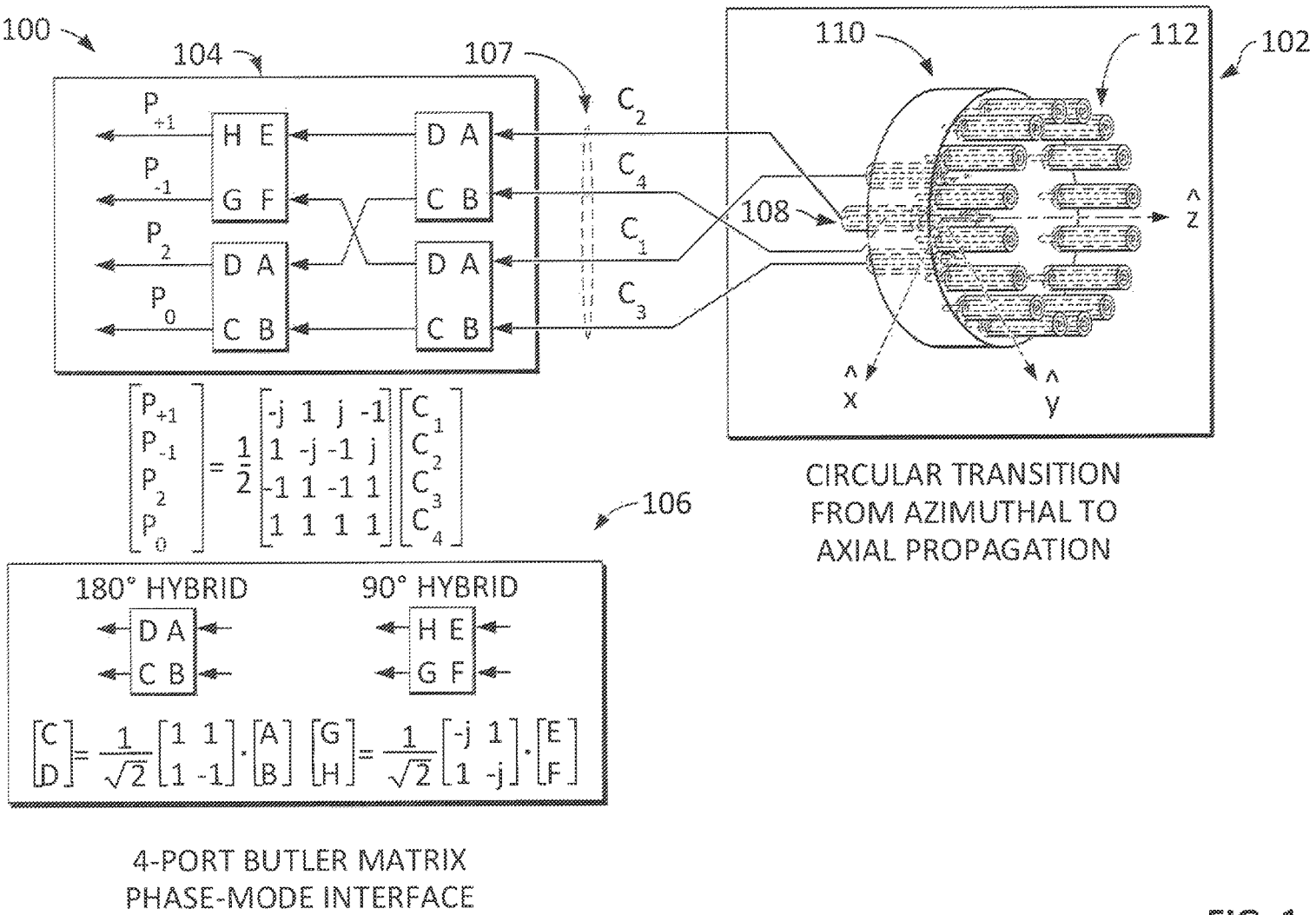
FIG. 1 illustrates a sparse phase-mode planar feed for circular arrays, in accordance with an embodiment of the present invention.

As used herein, the term "about" should be read as including variation from the nominal value, for example, a +/−10% variation from the nominal value. It is to be understood that such a variation is always included in a given value provided herein, whether or not it is specifically referred to.

As used herein, the terms "phase-mode of order m" and "$P_m$" are used interchangeably.

Embodiments of the present invention provide for an apparatus for sparse phase-mode feeding of an N-element antenna array, such as a ring-type circular or filled circular array. The apparatus comprises an M-by-M Butler Matrix circuit or similar component operatively coupled to a radial waveguide antenna feed. The radial waveguide includes M radially inner ports for coupling to the Butler Matrix circuit and N radially outer ports for coupling to the elements of the antenna array. The waveguide is radially symmetric and configured with the M inner ports radially inward of the N outer ports. Typically M<N, where N is arbitrary and M is a power of 2.

At least some and possibly all of the input/output ports of the Butler Matrix are configured for operative coupling to beamsteering circuitry. In various embodiments, input/output ports of orders magnitudes differing by "1", i.e. the ports corresponding to phase-modes |m|, |m±1| with |m| being of the lower order magnitudes, |m|<M/2 for an M-by-M Butler Matrix, are configured for operative coupling to the beamsteering circuitry. The value of m can be adjustable in various embodiments, for example to select which two phase-modes of consecutive order magnitude are used at a given time. When M is equal to four, phase-mode |m|=M/2 corresponds to the second phase-mode and is the highest order that can be used. In various embodiments, at least one of the input/output ports configured for operative coupling to the beamsteering circuitry is an input/output port corresponding to a phase-mode having an order magnitude greater than 1. In various embodiments, at least two of the input/output ports are configured for operative coupling to the beamsteering circuitry.

In various embodiments, at least three input/output ports of the Butler Matrix, corresponding to at least three different order magnitudes of phase-mode, are configured for operative coupling to the beamsteering circuitry, for example via pairwise operative coupling. An order magnitude corresponds to the absolute value of a phase-mode order, so that for example the +1 and −1 phase-modes are of the same order magnitude. Thus, when M is equal to four, the zeroth and second phase-modes are configured for operative coupling to the beamsteering circuitry, along with at least one of the +1 and −1 phase-modes.

In embodiments of the present invention, different combinations of phase-modes may be utilized by the beamsteering circuitry at different times. For example, different pairs of phase-modes having order magnitudes differing by one may be used for beamsteering at a given time. Using different pairs or combinations of phase-modes may provide for different radiation patterns, thereby increasing beamsteering flexibility. Although lower-order phase-modes may have higher directivities, the availability of higher-order phase-modes may be useful in various situations.

In some embodiments, pairs of phase-modes having order magnitudes differing by one are used in order to keep the relative difference in phase-progressions to one cycle, which corresponds to one pass around the circle of the antenna array. This may facilitate beamsteering by shifting the relative phases by a common number of electrical-phase units.

In various embodiments progressively higher order phase-modes are used to steer a beam progressively further off of the array axis. For example, to steer a beam close to the array axis, phase-modes $P_0$ and $P_1$ (or $P_{-1}$) may be used in combination. To steer the beam further from the array axis, phase-modes $P_2$ (or $P_{-2}$, if applicable) and $P_1$ (or $P_{-1}$) may be used in combination. Typically the phase-modes used in combination differ by an order magnitude of one. For M=8, phase-mode $P_4$ may be tested for feasible use with phase-mode $P_3$ (or $P_{-3}$), or substituted for the m=0 ($P_0$) phase-mode where it is used with the |m|=1 phase-modes $P_1$, $P_{-1}$. In some embodiments, the phase-mode of maximal available order and the zeroth order phase-mode may be switchably interchanged, i.e. substituted one for the other, in order to adjust the beam angle.

In various embodiments, the radial waveguide includes first and second parallel plates which are electrically coupled at their outer periphery to form a cylindrical cavity. A plurality of N antenna-element probes are provided which pass through apertures in the first plate and a plurality of M<N phase-mode feed probes are provided which pass through apertures in the second plate. The N antenna-element probes are disposed at a first distance from the center axis of the cylindrical cavity, while the M phase-mode feed probes are disposed at a second distance from the center axis of the cylindrical cavity which is smaller than the first distance. Thus, the radial waveguide has multiple input ports and multiple output ports. The M phase-mode feed probes are coupled to the antenna-side ports of a Butler Matrix.

In various embodiments, M is a power of two and the Butler Matrix is an M-by-M Butler Matrix having M antenna-side ports coupled to M input/output ports through components such as hybrid splitter/combiners, phase shifters, crossovers, and the like. In various embodiments, M is equal to four.

Embodiments of the present invention provide for a method for sparse phase-mode feeding of an N-element antenna array. The method includes coupling of beamsteering circuitry to input/output ports of an M×M Butler Matrix. The coupling includes coupling of an input/output port of the Butler Matrix of an order magnitude greater than one. As an example, the input/output port of maximal available order magnitude (|m|=M/2) may be used. Additionally or alternatively the coupling includes coupling of at least three input/output ports of the Butler Matrix corresponding to at least three lower and different order of phase-mode. The method further includes coupling the antenna-side ports of the Butler Matrix to M phase-mode feed probes of a radial waveguide antenna feed, and may further include coupling N antenna-element probes of the radial waveguide antenna feed to the N elements of the antenna array. The radial waveguide antenna feed may be structured as specified above.

In some embodiments, by utilizing the input/output port of orders greater than the minimum (m=0, m=−1), a greater beamsteering angular range from the array axis may be achieved. For example, for M=4, driving a particular configuration of a circular antenna array using the zeroth order phase-mode may result in a radiation pattern with a relatively narrow main lobe directed along or near a main axis of the array, whereas driving the antenna array using the second order phase-mode may result in a radiation pattern with a relatively wider main lobe farther from the main array axis (and possibly having minor lobes in other directions). Combining the zeroth order phase-mode with a first order phase-mode may allow for beamsteering off of the main axis of the array but with the direction of the steered beam differing from the main axis of the array by only a limited angle. In contrast, combining the second order phase-mode with a first order phase-mode may allow for beamsteering off of the main axis of the array, with the direction of the steered beam differing from the main axis of the array by a potentially larger angle. Thus, combining the second order phase-mode with a first-order phase-mode may lead to different beamsteering possibilities than combining the zeroth order phase-mode with the first-order phase-mode, since the second order phase-mode may have a wider beamwidth than the zeroth order phase-mode. Different combinations of phase-modes may be used to provide for different beamsteering options. Typically, to steer one main beam in any direction away from the array axis, one combines two phase-modes whose orders, m, differ by "1". (A larger difference will generally result in two or more beams in different, but mutually dependent directions.)

Similarly, in some embodiments, using three different order magnitudes of phase-modes, with two selected phase modes being used at a time, may allow for a wider range of beamsteering options, for example, for at least certain values of |m|, combining phase-modes of order magnitudes |m|−1 and |m| may allow for a beam which is offset from the longitudinal axis of the array by a smaller angle φ, whereas combining phase-modes of order magnitudes |m| and |m|+1 may allow for a beam which is offset from the longitudinal axis of the array by a relatively larger angle φ.

Embodiments of the present invention provide for a sparse phase-mode feed for coupling to a substantially arbitrary number N of elements of an antenna array such as a circular antenna array, without the necessity of a full N-port network. In an embodiment, up to M=4 phase-mode ports are used to feed the N elements of an antenna array, where N is greater than M. Embodiments of the present invention provide for an efficient antenna feed with limited feed losses and in which the feed and antenna array may be integrated in a planar structure. In an embodiment, the antenna array radiates in an axial direction which is orthogonal to the plane of the structure.

In contrast, other solutions for feeding a phase-mode feed network of arbitrary number N of elements use a full N×N Butler matrix or a Rotman Lens. However, it is desirable to have a method that is less lossy and/or less complex to manufacture accurately, especially at millimeter (mm)-wave frequencies. Furthermore, it is desirable to use antenna structures which radiate in an axial direction, rather than in an azimuthal direction.

In an embodiment, up to four phase-mode ports feed an arbitrary number of N antenna elements of a circular array for various low-order phase-modes (i.e., −1, 0, +1 and 2). The +2 phase-mode and −2 phase-mode may be indistinguishable from one another and constitute a degenerate phase-mode, hence the sign is often omitted herein when referring to the second-order phase-mode. In the general case of an M×M Butler matrix, the highest order of phase-mode is |m|=M/2 and is typically also a degenerate phase-mode. Embodiments of the disclosed systems and methods are implemented using a simple planar construction. The number, N, of antenna elements is not restricted to a power of 2 as it would be for example if a full N×N Butler Matrix was used to feed them directly. In an embodiment, only one 4×4 Butler Matrix, having four hybrid splitter/combiner components, is used to support up to four phase-mode feed ports. In contrast to larger order-N Butler Matrices, some embodiments of the present invention therefore are free of dedicated phase shifters to support the phase-mode feed ports. Disclosed embodiments allow a circular array of elements or sub-arrays to be co-integrated. The number of hybrid splitter/combiner components may be independent of the number, N, of antenna elements. An embodiment allows beamsteering circuits to be co-integrated.

Butler Matrix

Embodiments of the present invention comprise or relate to an M-by-M Butler Matrix having M antenna-side ports coupled to the M ports of the radial waveguide and M input/output ports for coupling to circuitry such as beamsteering circuitry. In various embodiments, M is equal to four. As such, the phase-modes may include a zeroth order phase-mode, a $1^{st}$ order phase-mode, a $-1^{st}$ order phase-mode, and a second order phase-mode.

In some embodiments, all input/output ports may be coupled to beamsteering circuitry, and selected input/output ports may be used, for example pairwise, at a given time, for example using switches. In some embodiments, the input/output ports corresponding to phase-modes of lowest available order, for example order 0, −1 and +1, are coupled to beamsteering circuitry, and, in addition, an input/output port corresponding to a phase-mode of higher available order is coupled to the beamsteering circuitry. In some embodiments, at least the input/output ports corresponding to three different order magnitudes of phase modes are coupled to beamsteering circuitry. For example, the zeroth-order phase-mode, one of the $1^{st}$ order and $-1^{st}$ order phase-modes, and the second order phase-mode may be utilized through respective port connections.

Coupling may include switchable coupling, in which an input/output port is connected to a switch which is operable to couple or decouple the input/output port to the beamsteering circuitry. In addition to the modes of operation noted above, by utilizing the phase-mode of maximal available order, and interchanging it with the zeroth-order phase-mode for combining with another phase-mode within the beamsteering circuitry, further possibilities for beamsteering may be achieved. It is noted that, since the phase-mode of maximal available order is degenerate in the sense of having no phase-progression in the circumferential direction, it may be more readily interchangeable with the zeroth-order phase-mode, which also has no phase-progression in the circumferential direction.

FIG. 1 schematically illustrates a 4-by-4 Butler Matrix operatively coupled to a radial waveguide transition assembly, in accordance with an embodiment of the present invention. The collection of the Butler Matrix and transition assembly correspond to a planar sparse phase-mode feed 100, with the antenna elements not shown for clarity of the drawing. The sparse phase-mode planar feed includes a planar, circular 4:N transition assembly 102 having four central phase-mode feed probes 108, a circular TEM region 110, N antenna-element probes 112 near the periphery of the circular TEM region 110, and a planar network of hybrids 106 connected as a 4-by-4 Butler matrix 104 having antenna-side ports $C_1$, $C_2$, $C_3$, $C_4$ which are sequentially connected to the four central phase-mode feed probes 108 of the circular TEM region 110 via equal-length transmission-lines 107. The Butler Matrix 104 includes four I/O ports $P_0$, $P_1$, $P_{-1}$, $P_2$ which form the electrical interfaces to the beamsteering system, such as those described in pending U.S. patent application Ser. No. 13/870,309 filed Apr. 25, 2013 and entitled "Simple 2D Phase-Mode Enabled Beamsteering Means" and in U.S. patent application Ser. No. 14/295,235 filed Jun. 3, 2014 and entitled "System and Method for Simple 2D Phase-Mode Enabled Beamsteering." U.S. patent application Ser. No. 14/692,520 also describes comparable configurations of a Butler Matrix coupled to a radial waveguide transition assembly. The above U.S. Patent references are hereby incorporated by reference in their entirety. The signals at the I/O ports are related to the signals at the antenna-side ports of the 4×4 Butler matrix according to the relation illustrated in FIG. 1, where $j=\sqrt{(-1)}$:

$$\begin{bmatrix} P_{+1} \\ P_{-1} \\ P_2 \\ P_0 \end{bmatrix} = \frac{1}{2}\begin{bmatrix} -j & 1 & j & -1 \\ 1 & -j & -1 & j \\ -1 & 1 & -1 & 1 \\ 1 & 1 & 1 & 1 \end{bmatrix}\begin{bmatrix} C_1 \\ C_2 \\ C_3 \\ C_4 \end{bmatrix} \quad (1)$$

The circular TEM region 110 serves to enable a transition from azimuthal propagation to axial propagation of the transverse electromagnetic (TEM) waves as they pass between the antenna elements and the Butler-matrix planar network. In other applications such as those involving acoustic waves, the same kind of transition between propagation modes is effected, but the probes 108, 112 in the transition assembly 102 may be of a different design and include transducers as appropriate for the acoustic or other medium.

In various embodiments, the Butler Matrix may include one quadrature hybrid and three sum-difference hybrids. Each of the 4×4 Butler Matrix I/O ports may include a corresponding one of the sparse phase-mode feed I/O ports, wherein each of the sparse phase-mode feed I/O ports corresponds to a respective one of a zeroth phase-mode, a 1st phase-mode a −1st phase-mode and second phase-mode. The feed may also include transducer element array connections coupled to the coaxial transducer pick-up probes, wherein the connections are arranged so as to maintain the same polarizations relative to axes fixed to the plane of the array. The apparatus may include an array of transducer elements coupled to the coaxial transducer pick-up probes. The array may include a plurality of sub-arrays, wherein at least one sub-array possesses a figure-eight azimuthal radiation pattern whose lobes are tangential to the circle of the sub-arrays, and wherein the axes of the sub-arrays are arranged radially with respect to a circle or to a polygon comprised by the array. In various embodiments, all sub-arrays or antenna elements have identical radiation patterns, identically oriented with respect to the circle or polygon of the main array. The array may be one of a substantially circular array, a substantially square array, and a polygonal array. In various embodiments, the azimuthal radiation pattern is not omnidirectional in the plane of the array and has low sidelobes. One example of such a pattern is the above-mentioned figure-eight radiation pattern. In various embodiments, the antenna feed is agnostic to the antenna element and/or subarray radiation patterns, provided sufficient antenna matching structures are used to couple the feed with the antenna elements.

As will be readily understood by a worker skilled in the art, the Butler Matrix may be implemented in various ways. For example, in some embodiments, the Butler Matrix may be implemented as microstrip-type components within a Printed Circuit Board (PCB). An outer surface of one of the ground planes of the radial waveguide transition assembly may be used as a ground plane for the microstrip-type components, thereby facilitating compactness and planar construction of the apparatus. The microstrip-type components may include quadrature and sum-difference hybrids. Other implementations, such as stripline implementations, may also be used.

The radial waveguide transition assembly may also be implemented wholly or partially as components in a PCB, for example in one or more PCB layers adjacent to the Butler Matrix components. For example, the radial waveguide transition assembly may comprise two coaxial circular conductive features on a pair of PCB layers, the two circular features being connected at their edge by a via fence. Apertures in the circular features may be provided into which probes are inserted. The probes may be provided as PCB features, or as external components mounted to the PCB.

It is noted that the above-described implementation of a Butler Matrix does not utilize phase shifters, thus reducing complexity. However, in various embodiments, other implementations of a Butler Matrix may also be utilized, as would be readily understood by a worker skilled in the art. For example, for M-by-M Butler Matrices with M>4, phase shifters may be utilized in some or all embodiments.

Radial Waveguide

Embodiments of the present invention comprise or relate to a radial waveguide transition assembly, which couples a plurality of N antenna-element probes to a plurality of M phase-mode feed probes. The antenna-element probes are arranged in a first circular pattern about a center axis of the radial waveguide and the phase-mode feed probes are arranged in a second circular pattern about the center axis, a radius of the first circular pattern being greater than a radius of the second circular pattern. The antenna-element probes may be mounted on an opposite face of the radial waveguide than the phase-mode feed probes. Alternatively, the antenna-element probes may be mounted on the same face of the radial waveguide as the phase-mode feed probes. The radial waveguide transition assembly is used to couple a relatively larger number N of antenna elements of a circular array to a relatively smaller number M of ports. The antenna array can then be operated as either a transmit or receive array using a phase-mode beamsteering operation.

In an embodiment, the disclosed feed network provides a circular transition region from azimuthal to axial Transverse Electromagnetic (TEM) propagation. The feed network includes substantially parallel conductive circular disks separated by about ¼ wavelength of dielectric. In various embodiments, the disk separation is less than or equal to about ½ wavelength. The diameter of the circular disks is dependent on the number, N, of circular-array elements so that their N pick-up probes are about ½ wavelength apart and ¼ wavelength from a circumferential vertical conductive wall joining the top and bottom circular disks. The feed network includes M=4 inner coaxial probes symmetrically spaced around the center of the circular disks, for example in a square with a diagonal of about $1/\pi$ wavelengths, or evenly spaced around a circle, about ¼ wavelength of arc apart. The four central feed probes have their outer conductors connected to the bottom disk and their inner conductors protruding about ⅛ wavelength into the space between the disks, but not touching the top disk. The N outer transducer pick-up probes have their outer conductors connected to the top disk and their inner conductors protruding about ⅛ wavelength into the space between the disks, but not touching the bottom disk. The other ends of the four central feed probe inner conductors are connected to the element ports of a planar 4×4 Butler Matrix via impedance-matching structures as may be required to match its characteristic impedance. The other ends of the N transducer pick-up probe inner conductors are connected to the transducer elements or sub-arrays via matched-impedance element-feed planar or non-planar networks.

In an embodiment, a sparse phase-mode feed for an array of antenna elements includes an electrically conducting first disk; an electrically conducting second disk substantially parallel to and coaxial with the first disk; an electrically conducting outer wall physically and electrically coupling outside edges of the first disk to outside edges of the second disk and defining a space between the first disk, the second disk, and the outer wall; a plurality of phase-mode feed probes, wherein at least a portion of the phase-mode feed probes are electrically coupled to the first disk, and wherein the phase-mode feed probes are substantially symmetrically arranged around the center of the first disk in a central region of the first disk proximate to the center of the first disk; and a plurality of antenna-element probes, wherein at least a portion of the antenna-element probes are electrically coupled to the second disk, and wherein the antenna-element pick-up probes are substantially symmetrically arranged on an outer portion of the second disk proximate to the outer edge of the second disk, wherein the number M of phase-mode feed probes is less than the number N of antenna element probes. The phase-mode feed probes are sequentially coupled to four antenna-side ports of a 4×4 Butler Matrix via equal-length transmission lines, and wherein each of the transducer pick-up probes are coupled to a respective one of a greater number of radiating elements in an array of antenna elements or wave transducers. The array includes one of a substantially circular array, a substantially square array, and a polygonal array. The array may include a main array or a plurality of sub-arrays. The space may be one of a vacuum or a dielectric. The phase-mode feed probes and the transducer pick-up probes may be coaxial transmission lines or TEM waveguides. Each of the Butler matrix input/output (I/O) ports corresponds to one of a plurality of sparse phase-mode feed I/O ports, wherein each of the sparse phase-mode feed I/O ports corresponds to a respective one of a zeroth phase-mode, a 1st phase-mode a −1st phase-mode and second phase-mode. In an embodiment, at least two of the I/O ports of the Butler Matrix is connected to beamsteering circuitry. Currently unused I/O ports may be terminated within the beamsteering circuitry, for example by switchably coupling unused ports to a terminating resistor. In an embodiment, at least the I/O port corresponding to the second phase-mode is coupled to the beamsteering circuitry, either continuously or switchably, along with at least one other I/O port.

Figure 2B:
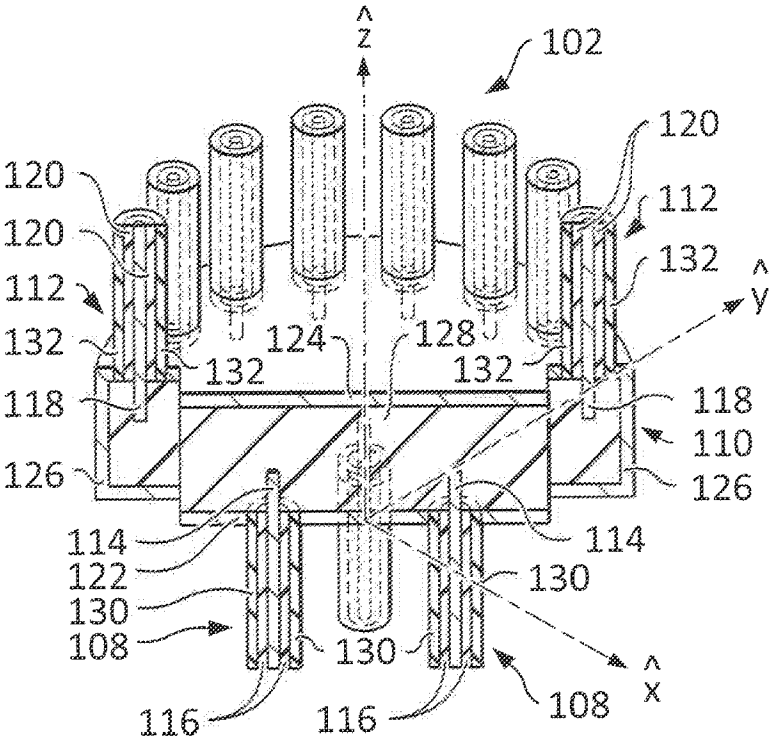
FIG. 2B is a cut-away perspective view of the transition assembly of FIG. 2A.
Figure 2A:
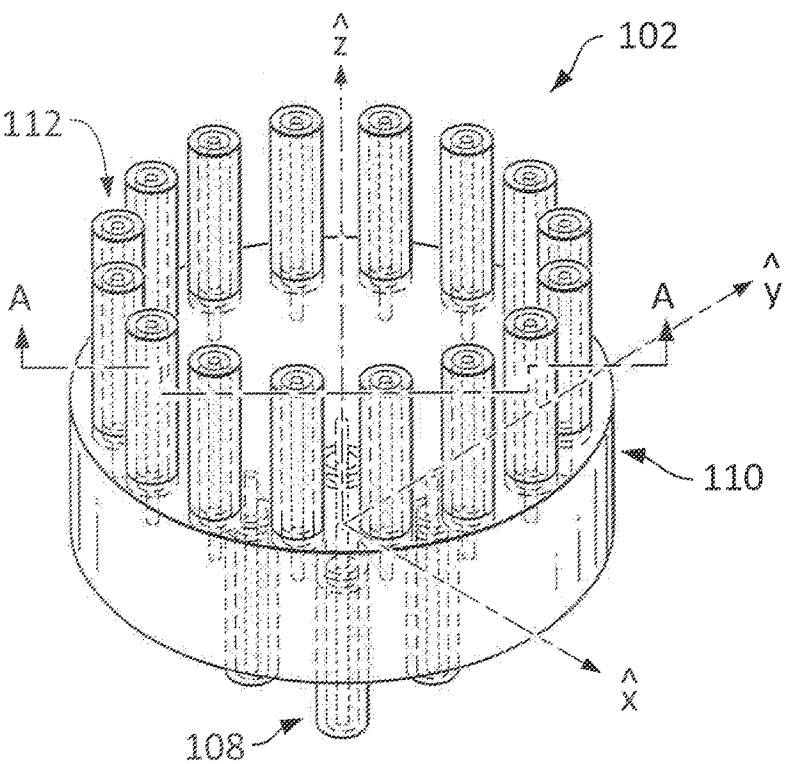
FIG. 2A is a perspective view of a transition assembly portion of the sparse phase-mode planar feed, in accordance with an embodiment of the present invention.
Figure 3:
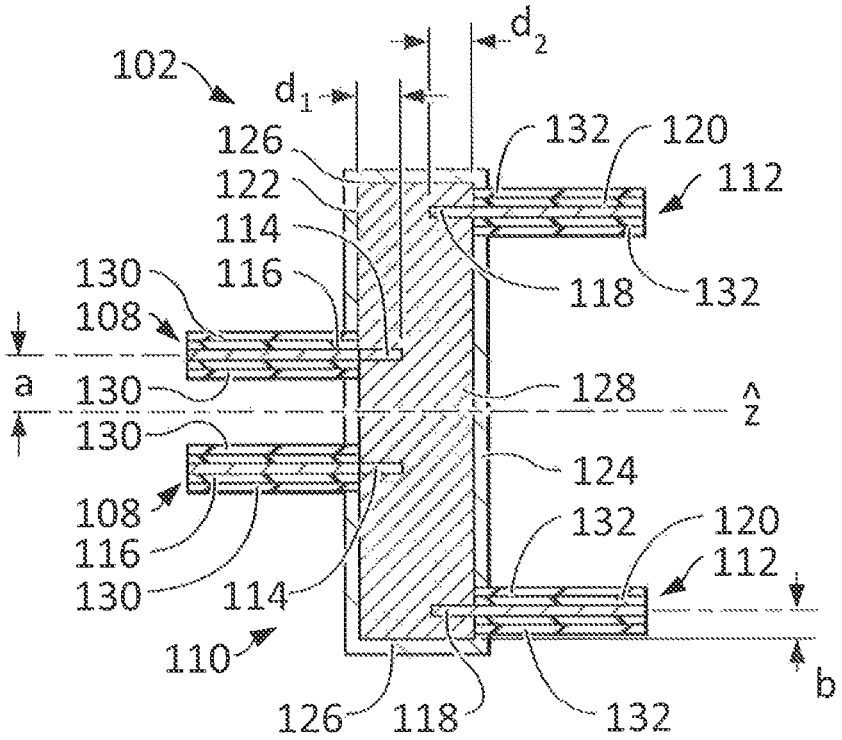
FIG. 3 is a cross-section view of the transition assembly of FIG. 2A.
Figure 4:
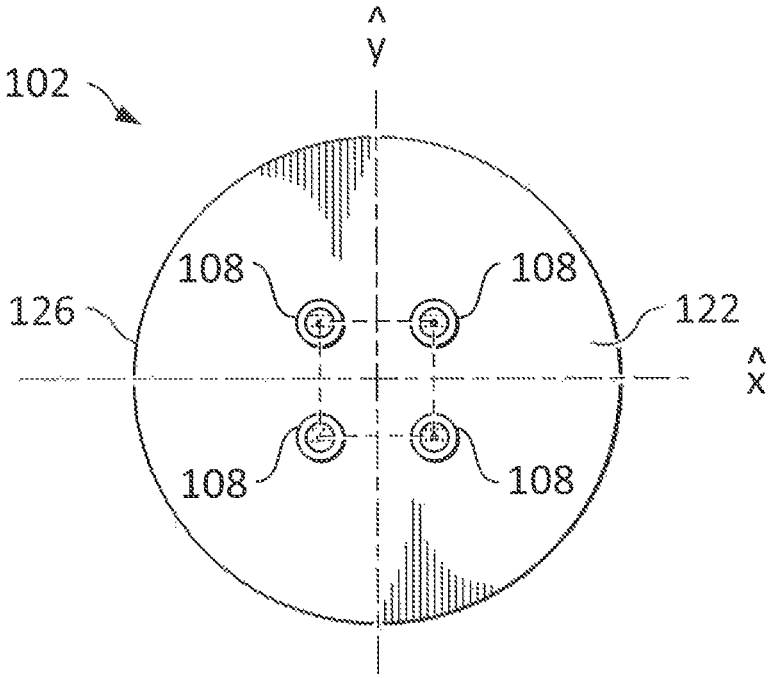
FIG. 4 is a bottom view of the transition assembly of FIG. 2A.
Figure 5:
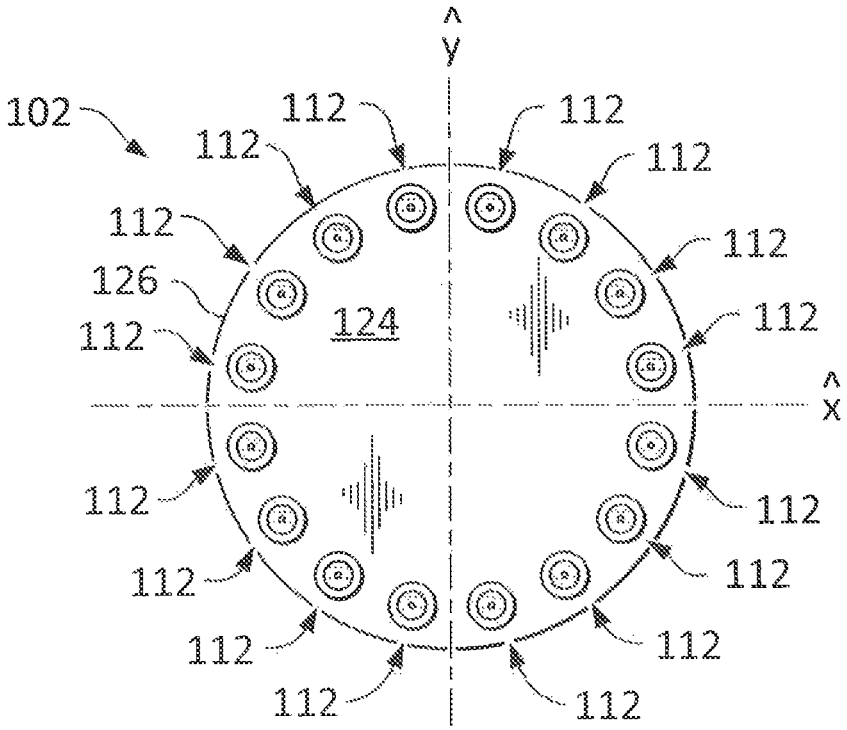
FIG. 5 is a top (antenna-side) view of the transition assembly of FIG. 2A.
Figure 6:
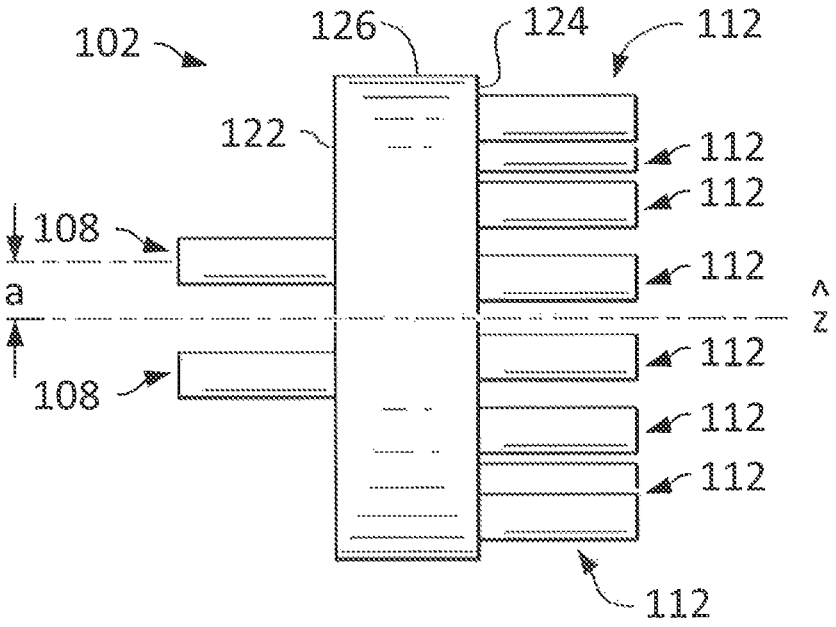
FIG. 6 is a side view of the transition assembly of FIG. 2A.

FIGS. 2A to 2B and FIGS. 3 to 6 illustrate various views of a 4:N planar circular radial waveguide transition assembly 102 of the sparse phase-mode planar feed 100, in accordance with an embodiment of the present invention, in particular with M=4 and N>M. FIG. 2A is a perspective view of the transition assembly 102. FIG. 2B is a cut-away perspective view of the transition assembly 102. FIG. 3 is a cross-section view of the transition assembly 102. FIG. 4 is a bottom view of the transition assembly 102. FIG. 5 is a top view of the transition assembly 102. FIG. 6 is a side view of the transition assembly 102. As used herein, the terms "top" and "bottom" are used to distinguish two sides of the sparse phase-mode planar feed 100 and do not indicate a specific orientation of the sparse phase-mode planar feed 100 in any frame of reference.

The transition assembly 102 includes a first component 124 and a second component 122 connected by an edge component 126. The first component 124 may also be referred to as a first surface, the second component 122 may also be referred to as a second surface, and the edge component 126 may also be referred to as an outer wall. The first component 124, second component 122, and the edge component 126 surround a cylindrical cavity 128. The first component 124, second component 122, and the edge component 126 are constructed from an electrically conducting material, such as copper or another metal. The edge component 126 is described herein as a wall, but the term wall, as used herein, does not necessarily imply a solid surface. In an embodiment, the wall is formed by a fence of spaced-apart conductive vias or other structures with dielectric therebetween. In an embodiment, the first component 124 and the second component 122 are oriented coaxially and parallel to each other. In an embodiment, the first component 124 and the second component 122 are each substantially circular flat disks, for example provided as conductive features within a Printed Circuit Board and connected at their edges by a via fence. The thickness of each disk is small as compared to the distance between the first and second components 124, 122. The cylindrical cavity 128 may be a vacuum or filled with a gas (e.g., air). In an embodiment, the cylindrical cavity 128 is filled with a dielectric material, for example corresponding to one or more dielectric layers of a Printed Circuit Board.

Those of ordinary skill in the art will recognize that the transition assembly 102 does not have to be a stand-alone structure, but may be embedded in some other structure. For example, the transition assembly 102 may be embedded in a larger, laminated planar structure with the edge component 126 implemented as a "fence" of plated-through via holes connected to the first component 124 and the second component 122, with probes built into the laminated structure for the central phased feed and the peripheral antennas. Furthermore, those of ordinary skill in the art will recognize that the first component 124 and the second component 122 do not have to be circular, but may include a portion of their surface that extends past the edge component 126. However, even in an embodiment in which the first component 124 and the second component 122 are not circular, a cylindrical cavity 128 containing a dielectric is defined by the first component 124, the second component 122, and the edge component 126.

Continuing with reference to the above-illustrated embodiment, N outer antenna-element (or transducer pick-up) probes 112 are coupled to the first component 124. In an embodiment, the outer probes 112 are coaxial probes. The diameter of each of the first and second components 124, 122 is dependent on the number, N, of circular-array antenna elements such that the N outer probes 112 are about ½ wavelength apart and ¼ wavelength from the edge component 126 (i.e., the circumferential vertical conductive wall joining the top (first component 124) and bottom (second component 122) circular disks). Each outer probe 112 includes an inner conductor 118 and an outer conductor 120. The N outer probes 112 have their outer conductors 132 connected to the first component 124 and the inner conductors 118 protruding about ⅛ of a wavelength into the cylindrical cavity 128 between the first component 124 and the second component 122, but not touching the second component 122. The outer conductors 132 and the inner conductors 118 are separated by a dielectric layer 120.

Four feed probes 108 are coupled to the second component 122. In an embodiment, the feed probes 108 and pick-up probes 112 are coaxial probes. The four feed probes 108 are symmetrically spaced around the center of the second component 122. In an embodiment, the feed probes 108 are about $1/(\pi\sqrt{2})$ wavelength apart in a square or about ¼ wavelength along a circle whose diameter is the diagonal of the square. Each feed probe 108 includes an inner cylindrical conductor 114 and an outer coaxial cylindrical conductor 130 separated by a dielectric 116. It should be understood that feed probes of different shapes could alternatively be used. The outer conductor 130 is electrically coupled to the second component 122. The inner conductor 114 protrudes about ⅛ wavelength into the cylindrical cavity 128 between the second component 122 and the second component 124, but does not touch the first component 124. The wavelength, λ, is the carrier or center operating wavelength of a radio-frequency (RF) signal nominally received or transmitted by the antenna elements. The distance between the first and second component 124, 122 is at least about ¼ wavelength. In some embodiments the distance between the first and second component less than or equal to about ½ wavelength.

As will be readily understood by a worker skilled in the art, coaxial probes include an inner conductor and an outer conductor, wherein the inner conductor is electrically separated from the outer conductor along a length of the coaxial probe. The coaxial probe may include a coaxial transmission line segment. At a terminus of this transmission line segment, the inner conductor may extend beyond the outer conductor.

In embodiments where M>4 phase-mode feed probes are required, the phase-mode feed probes may be spaced at regular intervals along a circle of given radius, the radius being selected such that the M feed probes are between about ¼ wavelength and about ½ wavelength apart as measured along the arc of the circle.

In some embodiments, a central circular structure coupling the waveguide conducting surfaces, may be provided radially inward of the M feed probes. This structure may be a via or a via fence for example. The structure may be located at least about ¼ wavelength radially inward from the circular arrangement of feed probes radially. The presence of this structure may be useful for M larger than 4 or even for M=4, for example by allowing the feed probes to be more widely spaced. In some embodiments, a passive structure may be implemented in the center of the cylindrical waveguide which is attached to the top and bottom waveguide conducting surfaces, the passive structure being configured to increase bandwidth and maintain purity of the phase-mode excitations.

The inner conductors of the four feed probes 108 are connected to the antenna-side ports of a planar 4×4 Butler Matrix 104, as illustrated in FIG. 1, via equal-length transmission lines 107 while matching their characteristic impedance to that of network 104 as required. The inner conductors of the N outer transducer pick-up probes 112 may be connected to the transducer elements or antenna elements or sub-arrays via equal-length transmission lines and impedance-matching and balancing networks as required. In the depicted embodiment, N=16. However, those of ordinary skill in the art will recognize that N may be substantially any integer number. Furthermore, in other embodiments, other probe designs, such as magnetic loops, are utilized. In yet other embodiments, matching structures built on some of the surfaces surrounding any type of probes, including coupling slots, may be utilized for the probe design. Those of ordinary skill in the art will recognize that other probe designs other than those described herein may also be utilized.

In various embodiments, the planar circular transition assembly provides a circular transition from azimuthal to axial propagation (and vice versa).

In a particular embodiment, λ=1.876 millimeters (mm). The dielectric used in the coaxial probes and between the disks has the following properties: $\varepsilon_r$=7.1, DuPont 9K7 LTCC material, f=60 Gigahertz (GHz). The disk separation=0.53 mm (i.e., 0.2824λ or approximately λ/4). The four inner feed probes' 108 spacing, "a" (from center of disk to center of probe 108)=0.298 mm (approximately λ/2π), so spacing was √(2)*0.298=0.421 mm (or approximately λ/4 along the arc length). The probe heights, "$d_1$" and "$d_2$", between the first component 124 and the second component 122=0.234 mm (i.e., approximately λ/8). The diameter of the inner layer 114, 118 of the probes 108, 112 is about 115 microns (m) (~0.0617λ). The coaxial port outer diameter is about 200 m (~λ/10). The 16 outer probes 112 are spaced apart approximately λ/2 at a radius of $R_e$=2.3886 mm. $R_e$ is the radius of the circle on which lie the pick-up probes for the antenna elements. The outer wall, which may be formed as a via fence for example as done with substrate-integrated waveguides (SIW) in Printed Circuit Board (PCB) implementations, connects the top and bottom metal disks at $R_d=R_e+\lambda/4=2.8576$ mm. $R_d$ is the radius of the cylindrical conducting wall connecting the top and bottom circular metal disks. It should be understood that the top and bottom metal disks could, in some embodiments, be just the circular regions of top and bottom conducting surfaces extending beyond $R_d$ (e.g., ground planes for other circuitry on the bottom and ground plane for the antenna structure). The 4×4 Butler Matrix, including one quadrature and three sum-difference hybrids, may be implemented in microstrip, with the bottom disk (i.e., second component 122) used as a ground plane. Those of ordinary skill in the art will recognize that in other embodiments, different numbers of hybrids and/or other types of hybrids and phaseshifters, or other networks in general that perform a mathematically equivalent function (e.g., within a scaling factor of equation (1)) may be utilized in place of the disclosed one quadrature and three sum-difference hybrids disclosed herein. The element connections are arranged so as to maintain the same polarizations relative to the planar (x-y) axes and may include subarrays having a figure-eight azimuth pattern whose lobes are tangential to the circle of their array. The probes 108, 112 are terminated in 12.06 Ohms. The outer cylinder of coaxial probes 108, 112 are connected to the second component 122 and first component 124, respectively.

In an embodiment, grounded-via fences separate the four inner feed probes 108 in a microstrip or stripline layer.

Beamsteering Circuitry

Embodiments of the invention comprise or relate to beamsteering circuitry which is coupled to at least some input/output ports of the Butler Matrix. In general, the beamsteering circuitry is configured to effect a particular transmit or receive beam radiation pattern at the antenna array by coupling to selected input/output ports of the Butler Matrix, with selected amounts of phase shifts, signal amplification/attenuation, or the like, applied to these couplings. The beamsteering circuitry may include phase shifters, variable ratio combiners, amplifiers, integrators, and the like. In various embodiments, a control input specifying beam angle, for example in terms of the $(\theta,\varphi)$ coordinate system described herein, is provided to and used by the beamsteering circuitry to effect the beam at the specified beam angle.

Various aspects of beamsteering circuitry embodiments, as well as examples of steered beams, are described below in order to elucidate operation of embodiments of the present invention.

Figure 7A:
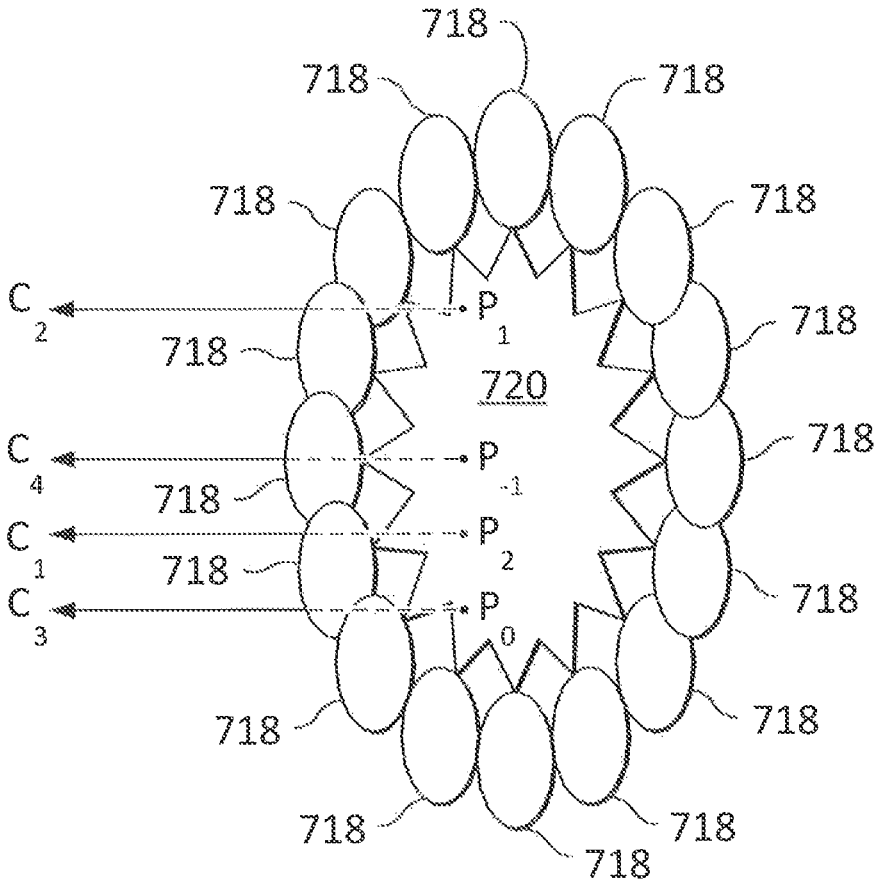
FIG. 7A is a conceptual illustration of an embodiment of the disclosed sparse phase-mode planar feed for circular arrays.

FIG. 7A is a conceptual illustration of a sparse phase-mode feed apparatus for circular arrays provided in accordance with an embodiment of the present invention, wherein the substantially circular array of antenna elements to which the apparatus interfaces is represented by the patches 718. The sparse phase-mode feed apparatus proper is represented by the star-shaped planar entity 720 whose points symbolize the antenna-element electrical interfaces and the feed lines terminating at input-output (I/O) ports $P_0$, $P_1$, $P_{-1}$, $P_2$ symbolize the beamsteering and/or receiving system electrical interfaces, where the phase-mode far-field patterns are effected.

Figure 7B:
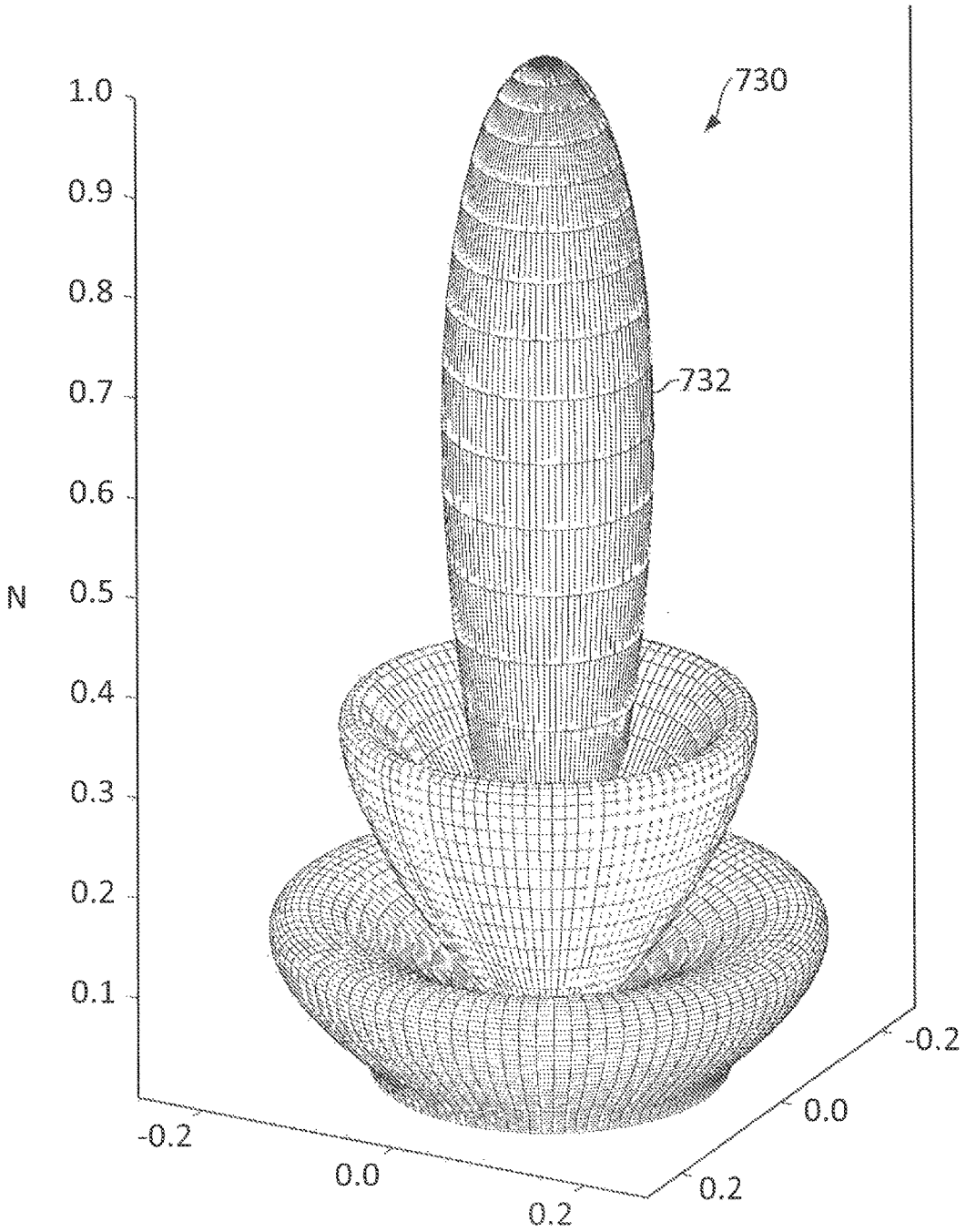
FIG. 7B is a graph illustrating a circularly-symmetrical far-field pattern of zeroth order phase-mode $P_0$ of a 16 element, $\lambda/2$ spaced circular ring array.

FIG. 7B is a graph 730 illustrating a circularly-symmetrical far-field radiation pattern of a zeroth order phase-mode $P_0$ of a 16 element, $\lambda/2$ spaced circular ring array.

Figure 7C:
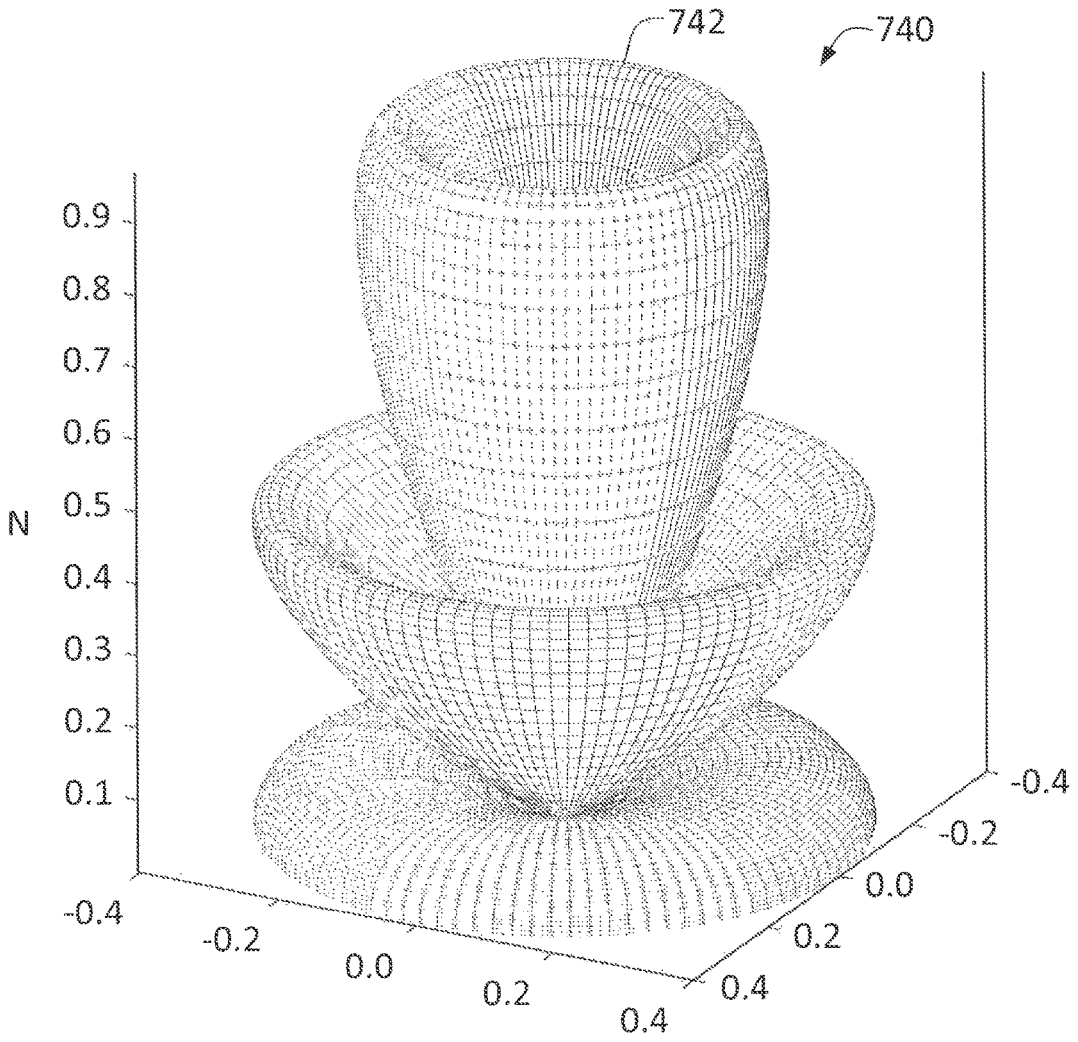
FIG. 7C is a graph illustrating a circularly-symmetrical far-field pattern of 1st order phase-mode $P_{-1}$ (equal to the negative complex-conjugate of 1st order phase-mode $P_1$) of a 16-element, $\lambda/2$ spaced circular ring array.

FIG. 7C is a graph 730 illustrating a circularly-symmetrical far-field radiation pattern of −1st order phase-mode $P^*_{-1}$ of a 16-element, $\lambda/2$ spaced circular ring array. The superscript (*) represents the complex conjugate operation. The far-field pattern of 1st order phase-mode $P_1$ of a 16 element, $\lambda/2$ spaced circular ring array is the same shape as the illustrated graph 730, but with its phase progression in the opposite direction around the symmetry axis.

Figure 7D:
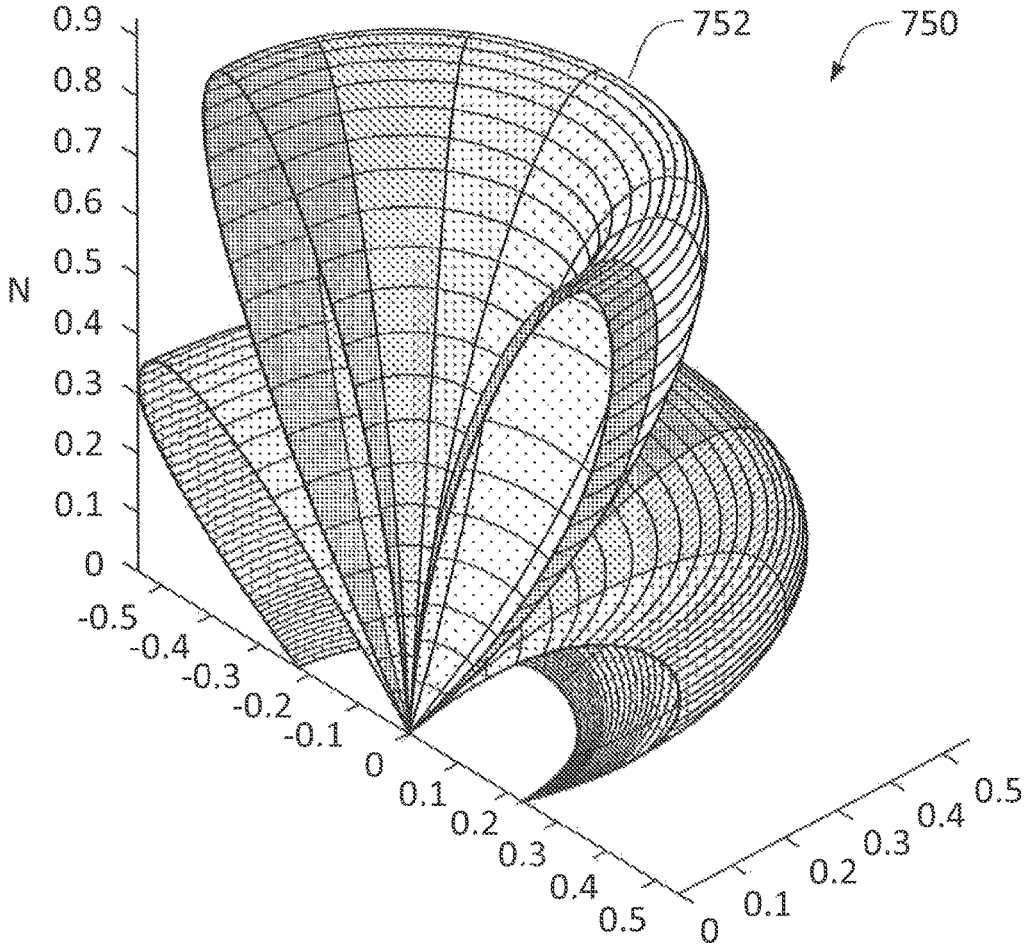
FIG. 7D is a graph illustrating a half of the circularly-symmetrical far-field pattern of second order phase-mode $P_2$ of a 16 element, $\lambda/2$ spaced circular ring array.

FIG. 7D is a graph 750 illustrating a possible circularly-symmetrical far-field radiation pattern of a second order phase-mode $P_2$ of a 16-element, $\lambda/2$ spaced circular ring array. It is noted that, in the case of a 4×4 Butler Matrix, the second order phase-mode $P_2$ is considered degenerate and the corresponding radiation pattern may differ in such cases.

In the disclosed embodiment, all antenna elements are shown to be omnidirectional and identically linearly or circularly polarized with respect to the x, y, and z axes. However, it will be understood that other arrangements are possible, such as radially symmetric antenna elements with polarizations that are identically oriented with respect to their radials from the center of the circular or polygonal array (in which case the phase-mode orders at the I/O ports may change). For example, $P_{-1}$ may become $P_0$, $P_0$ may become $P_1$, and $P_1$ may become a non-degenerate $P_2$. In the zeroth order phase-mode, $P_0$, there is no phase progression in the element excitations around the circular ring array (all elements are fed in phase), so there is no phase-progression in the circumferential direction around the array (z) axis. Thus all the fields add in-phase on the array axis and form the main beam in the far field. FIGS. 7B to 7D illustrate normalized plot of the far field for a 16-element ring array with elements spaced half-wavelength apart around the circumference and non-zero phase progressions around the circumference.

With further reference to FIGS. 7B to 7D, the main lobe 732 in the far-field radiation pattern for phase-mode $P_0$ has a constant phase. The far-field radiation pattern for the $P_1$ phase-mode has a varying phase in the main lobe 742 ranging from $-\pi$ to $+\pi$ radians. The far-field radiation pattern for the $P_{-1}$ phase-mode also has a varying phase in its main lobe but in the opposite circumferential direction to that of the $P_1$ phase-mode. The phase progressions in the $P_1$ and $P_{-1}$ modes' far-field patterns are one complete cycle of 27*n* radians but in opposite directions around the z-axis, which is the same as their element excitation phase progressions. The far-field radiation pattern for the $P_2$ phase-mode has a varying phase in the main lobe 752 ranging over $4\pi$ radians.

Figure 8:
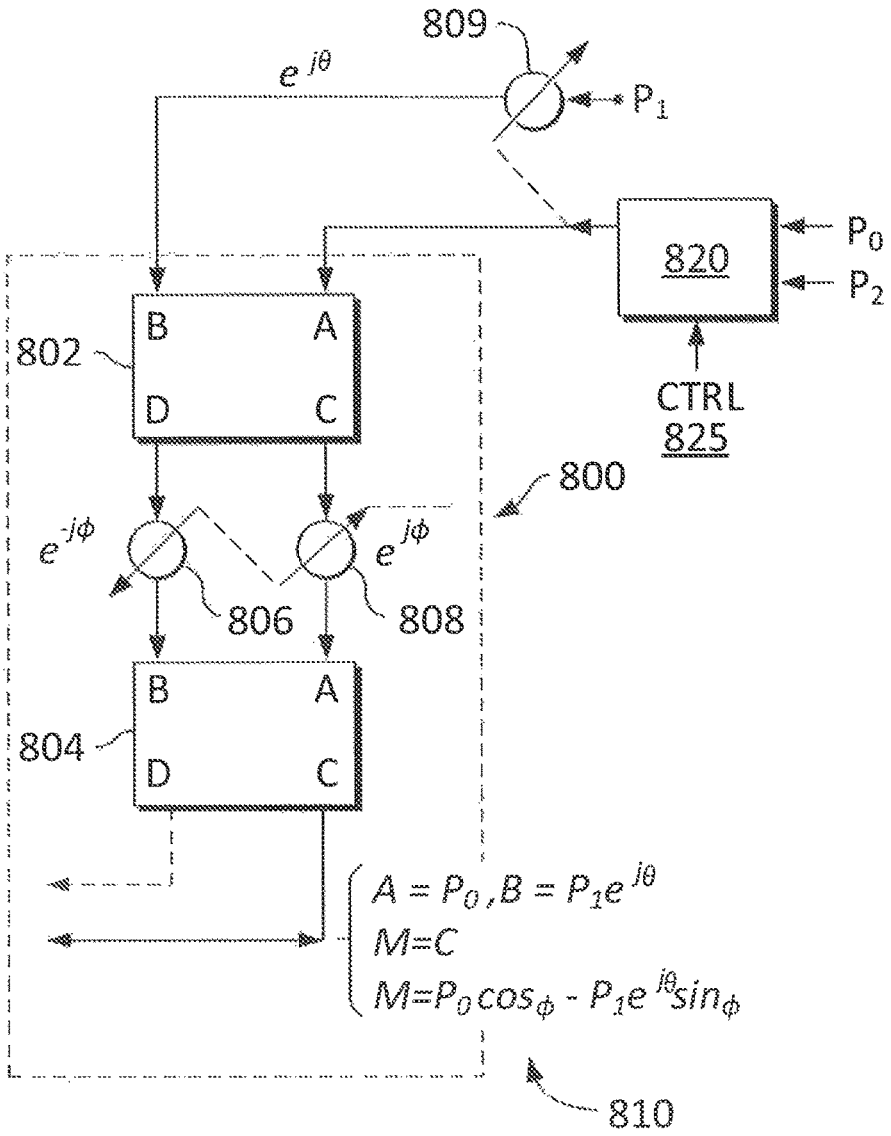
FIG. 8 illustrates beamsteering circuitry provided in accordance with an example embodiment of the present invention.

FIG. 8 illustrates beamsteering circuitry or a portion thereof provided in accordance with an embodiment of the present invention. This circuitry is intended to illustrate one example of a circuit which utilizes the second order phase-mode for beamsteering. The circuitry includes a variable-ratio combiner 800 controlled by setting phase shift $\varphi$, with phase shift $\theta$ applied to input B. The variable ratio combiner 800 includes two hybrid splitters/combiners 802, 804 and two oppositely adjusted phase shifters 806, 808. Each hybrid splitter/combiner 802, 804 has two inputs, A and B, and two outputs, C and D. The input A for the hybrid splitter/combiner 802 is coupled to the $P_0$ phase-mode and/or the $P_2$ phase-mode from the far-field of an array of antennas (not shown). The input B for the hybrid splitter/combiner 802 is the $P_1$ phase-mode from the far-field of an array of antennas, and is phase shifted by phase shifter 809. The output C of hybrid splitter/combiner 802 is the input for phase shifter 808, and the output D of hybrid splitter/combiner 802 is the input for phase shifter 806. The output from phase shifter 806 is the input B for the hybrid splitter/combiner 804 and the output from phase shifter 808 is the input A for the hybrid splitter/combiner 804. The output C from the hybrid splitter/combiner 804 is the main (M) output where the steered main beam is effected. The output D from the hybrid splitter/combiner 804 is the auxiliary output which may be terminated or used for secondary functions such as interference mitigation. Although FIG. 8 illustrates connection to the $P_1$ phase-mode, alternatively the $P_{-1}$ phase-mode, or a combination of the $P_1$ and $P_{-1}$ phase-modes, may be connected. A more detailed description of relevant beam-steerer systems and variations thereof are provided in U.S. patent application Ser. No. 14/295,235.

Additionally in FIG. 8, a circuit 820, such as a signal mixing circuit, variable ratio combiner, or switch, is provided for controllably coupling the $P_0$ port, the $P_2$ port, or a combination thereof, to the input A of the hybrid splitter/combiner 802. A control input 825 may be provided for controlling operation of the circuit 820, for example to switchably couple a selected one of the ports to the input A, or to couple a controllably weighted mixture of signals at the two ports to the input A. Controlling which of the $P_0$ port or the $P_2$ port is coupled with the input A, or a controlling the weighting with which these two ports are coupled in combination with the input A, may be used to control the offset of the beam angle from the radial axis of the antenna array. Although connections to ports $P_0$, $P_1$ and $P_2$ are illustrated in FIG. 8, other port connections may be possible, for example such that phase-mode ports of the Butler Matrix which differ by an order of one are pairwise connected to the beamsteering circuitry.

Figure 9A:
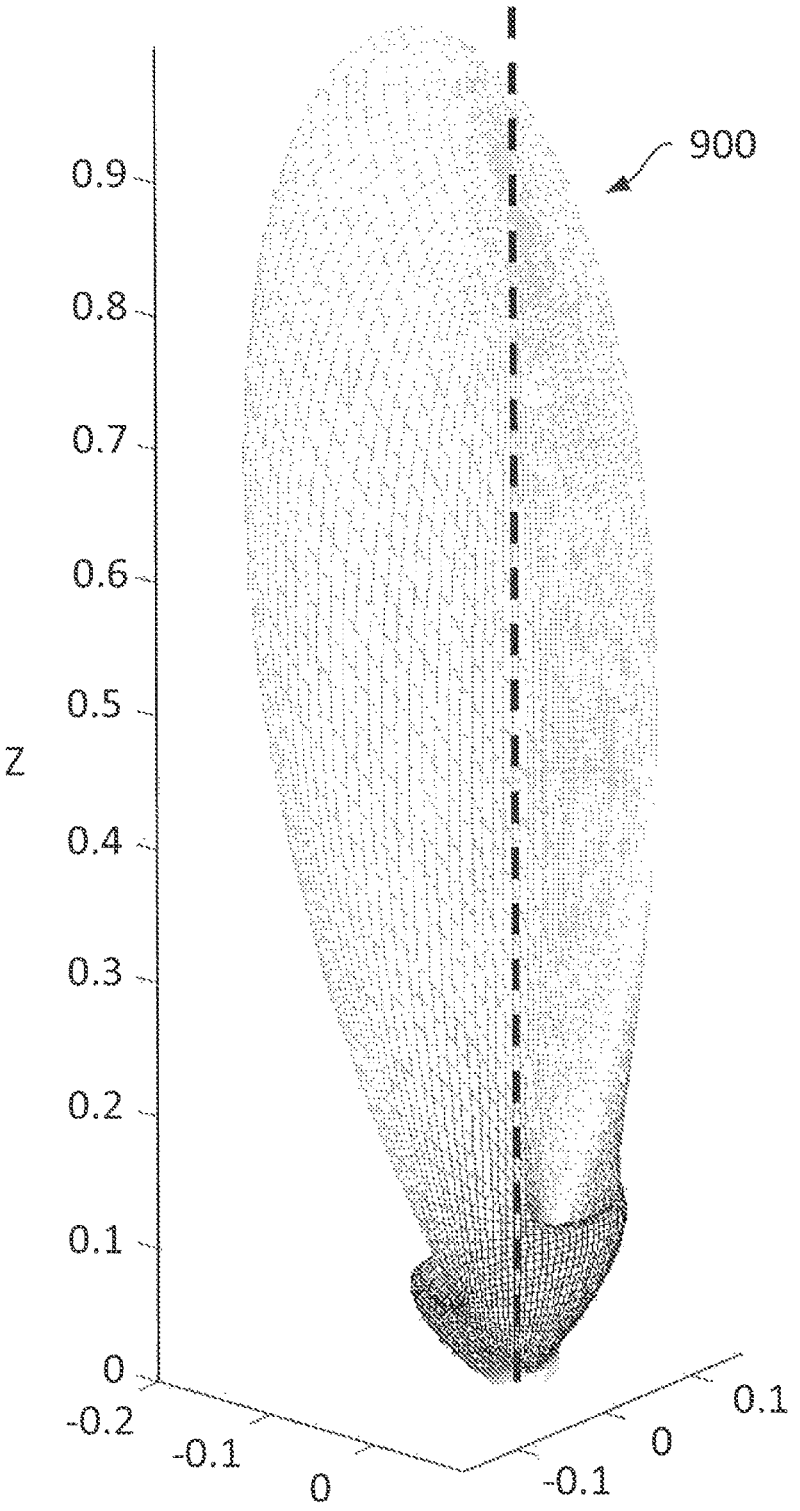
FIG. 9A illustrates a plot of an example of a resultant steered-beam far-field radiation pattern at the main (M) output C from the beam-steerer system of FIG. 8, when using the $P_0$ port.

FIG. 9A illustrates a plot of an example of the resultant steered-beam far-field radiation pattern 900 effectively seen at the main (M) output C from the beam-steerer system of FIG. 8. The pattern 900 corresponds to 87.5% coupling of the $P_0$ port to the beamsteering circuitry and uncoupling of the $P_2$ port, and about 12.5% coupling of the P1 phase-mode whose phase is shifted by 0.75 radian.

Figure 9B:
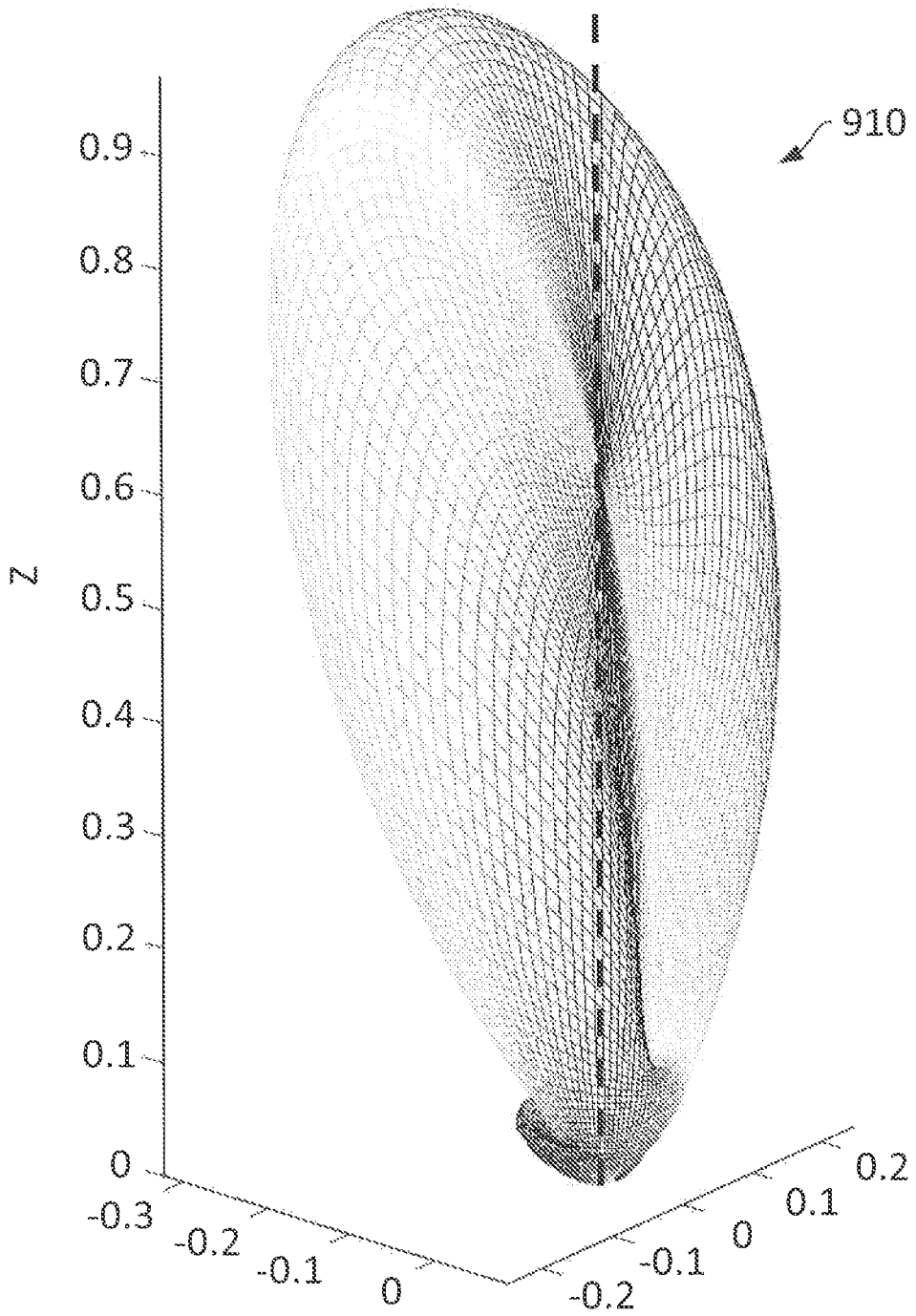
FIG. 9B illustrates a plot of another example of a resultant steered-beam far-field radiation pattern at the main (M) output C from the beam-steerer system of FIG. 8, when using the $P_2$ port.

FIG. 9B illustrates a plot of an example of the resultant steered-beam far-field radiation pattern 910 effectively seen at the main (M) output C from the beam-steerer system of FIG. 8. The pattern 910 corresponds to substitution of the $P_2$ port connection to the beamsteering circuitry in place of that of the $P_0$ port, with the same parameter settings as in the above paragraph. The pattern 910 has a main lobe which is pointed further away from the radial axis of the array than the pattern 900. That is, the beam angle $\varphi$ is greater for pattern 910 than for pattern 900.

Figure 10:
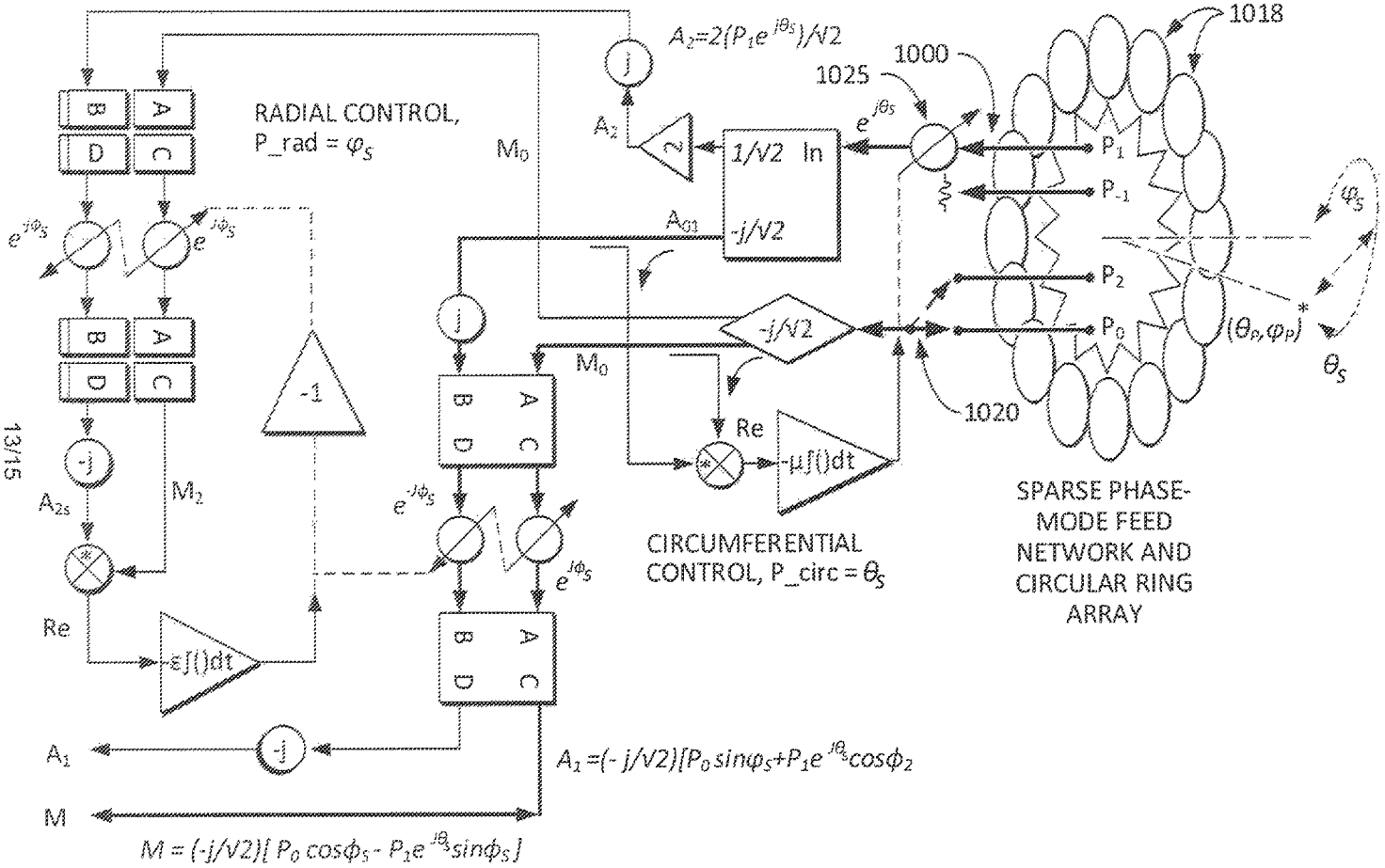
FIG. 10 illustrates beamsteering circuitry provided in accordance with another embodiment of the present invention.

FIG. 10 illustrates beamsteering circuitry provided in accordance with another embodiment of the present invention. This circuitry provides for extended radial steering range by switchably using both the zeroth order phase-mode and the second order phase-mode. As illustrated, the beamsteering circuitry is operatively coupled to the phase-mode feed network 1000 and ring antenna array of antenna elements 1018. The two ports $P_0$ and $P_2$ of the phase-mode feed network 1000 are operatively coupled to a switch 1020 which is configured to select which of these two ports is used. The port $P_1$ is operatively coupled to the beamsteering circuitry via a phase shifter 1025, and the port $P_{-1}$ is terminated. Alternatively, the port $P_1$ is terminated and port $P_{-1}$ is connected to the beamsteering system via a phase shifter.

The orientation of the steered beam main lobe can be characterized, relative to the radial axis of symmetry of the circular array, by a pair of angles $\theta$ and $\varphi$, where $\varphi$ is the angular difference between the direction of the steered beam and the radial axis of symmetry of the circular array, and $\theta$ is the angle of the steered beam in the circumferential direction, in the plane of the array. For smaller values $\varphi$, port $P_0$ may be used, while for larger values of $\varphi$, port $P_2$ may be used. Control of $\theta$ may be performed, with a choice of phase-modes differing in order by "1" in part by tuning of the phase shifter 1025. As such, port $P_2$ may be used to extend the radial steering range of the array for a substantially arbitrary independently-set circumferential direction of steering.

A more detailed description of relevant beam-steerer systems and variations thereof in relation to FIG. 10 is provided in U.S. patent application Ser. No. 13/870,309.

Antenna Array

Embodiments of the invention comprise or relate to an array of antenna elements which are respectively coupled to the antenna element probes of the array feed. The array may be a circular array comprising antenna elements arranged in a ring shape. In some embodiments, the array is a filled circular array having antenna elements substantially covering a two-dimensional space bounded by a ring. In some embodiments, the array elements may themselves be arrays of smaller elements, termed sub-arrays herein. In yet other arrangements, the complete array may consist of a plurality of concentric and/or coaxial ring-shaped sub-arrays which may be potentially dedicated to different subsets of phase-modes.

In various embodiments, the antenna array may be characterized as a planar uniform circular array of radiating or receiving transducer elements.

In some embodiments, a central radially-symmetrical structure may be added to reduce coupling across the array. The structure may, for example, be a corrugated surface or electromagnetic bandgap surface, or the like, which is configured to provide a sufficiently high electromagnetic impedance that reduces antenna element coupling.

In some embodiments, a main direction of radiation of the antenna elements is substantially perpendicular to the plane of the array. In case of electromagnetic elements (antennas), their polarizations can be linear or circular, but, in an embodiment, should all be identical, with consideration given to the phases of their excitations such that the zero-order phase-mode combiner will correspond to no phase progression of excitations around the circle, the +1 order phase-mode to an excitation-phase progression from 0 to $2\pi$ radians in one direction around the circle, and the −1 order phase-mode to an excitation-phase progression from 0 to $2\pi$ radians in the opposite direction around the same circle. The second order phase-mode may correspond to an excitation-phase progression from 0 to $4\pi$ radians around the circle, that is, the phase may progress through two full cycles around the circle.

Although theoretically there may be positive and negative second order phase-modes, when M=4 the second order phase-mode is degenerate as it is the phase-mode of highest order magnitude. Degeneracy of a phase-mode may correspond to that phase-mode having no direction of phase-progression. The degeneracy may be related to the fact that, in an M×M Butler Matrix, there is only one port corresponding to a phase-mode of magnitude M/2. The degeneracy may be viewed as an indistinguishability of the +(M/2) and −(M/2) phase-modes. For example, for M=4, the Butler Matrix may have four antenna-side ports circularly spaced at 90 degree intervals, with adjacent probes being 180 degrees out of phase, which contributes to indistinguishability of the $2^{nd}$ order and $-2^{nd}$ order phase-modes. Further, the +(M/2) and −(M/2) phase-modes may be viewed as collapsing to one degenerate highest-order phase-mode.

In embodiments, each phase-mode is available at a separate output of the feed network. The various phase-modes (i.e., 0, 1, −1, 2) are provided using a 4×4 Butler Matrix. Their order may be shifted if the element polarization axes are arranged to be radially symmetric, as opposed to uniformly-directed with respect to Cartesian coordinates of the plane of the array.

The disclosed sparse phase-mode planar feed and beamsteerers for antenna arrays are herein described in greater detail of their principles of operation, in the context of a steerable millimeter-wave array antenna. Specifically, in an embodiment, the antenna includes a planar ring of identical radiating (or receiving) elements connected to a phase-mode beamforming network and radiating nominally in the direction orthogonal to the plane of the array (along the array axis).

In the case of an electromagnetic antenna, the array elements may be of linear or circular polarizations. In the case of circular polarizations, they may be arranged with their polarization axes and feedpoints symmetrically around the center, so that the physical angle of the polarization will also progress linearly around the circumference by one cycle, resulting in one of the 1st order phase-modes. In an embodiment, phasing arrangements compensating for this phase-progression will form the zeroth order phase-mode. Other phase-mode feed arrangements for linearly-polarized elements may be devised, such as portions of a Butler matrix or Rotman lens, spatial or guided-mode feeds and other arrangements employed by those skilled in the art. In an embodiment, the end result is a phase-mode feed structure of a circular or polygonal ring array having output ports corresponding to the zeroth, +1st, −1st and second order phase-modes. In general, there may be M/2 magnitude-orders of phase-mode, where M is also the number of central feed probes. The highest magnitude-order of phase-mode, namely M/2, may be degenerate in the sense of having no direction of phase-progression.

Although described herein primarily with reference to a circular array, in other embodiments, the antenna array may be a square shape, polygonal shape, and/or a filled or partially-filled array.

In various embodiments, the array of antennas may include sub-arrays with radial or uniform polarization axes to effect phase-modes in case of circular polarization and re-order phase-mode ports. The sub-arrays are not shown, but would be easily implemented by a person having ordinary skill in the art. The sub-array may include several antenna elements. In an embodiment, the sub-array axes are arranged radially with respect to the center of the largest circular structures disclosed herein.

Additional Details

Embodiments of the disclosure avoid using a full N×N Butler Matrix or similar network as only M<N of the lowest-order (four or fewer in the illustrated case) phase-modes are utilized. Additionally, embodiments of the disclosure avoid the losses of N×N matrix feeds at mm-waves and maintain a planar, circularly-symmetric structure. Axes of element-patterns or axes of sub-array patterns may be independent of polarization axes. In an embodiment, a 4×4 Butler Matrix with four I/O ports and 4 antenna-side ports is utilized for transmitting and receiving signals to and from a planar TEM-wave transition region (e.g., space 128 in FIG. 3) between azimuthal and axial propagation of phase-modes.

Some embodiments of the present invention are commercially desirable in products such as small-cell backhaul, mobile satellite and other microwave or mm-wave point-to-point radios since the embodiments facilitate an auto-alignment and tracking feature for the antenna by requiring very few expensive mm-wave parts. Auto-alignment, in turn, reduces installation times and costs of such links, especially on mobile or less-rigid, street-level platforms. Fabrication is simplified by the simple circular planar structure of some embodiments.

The all-planar construction of embodiments of the present invention facilitates integration with axially-radiating circular antenna arrays and 2-axis phase-mode-enabled steering subsystems. The all-planar construction may facilitate coaxial stacking in a multiple-band design. Furthermore, these embodiments avoid having coaxial-to-planar transitions, many cross-overs, and meander lines that are required for N×N matrix-type feeds and generally increase their losses.

Embodiments of the present invention allow for low-sidelobe axial (steered) beam with circular, elliptical, linear, or arbitrary polarization. Embodiments of the sparse phase-mode planar feed have an order of N/M (N/4 in the illustrated case) advantage over other solutions using a full N×N feed network. The sparse phase-mode planar feed leaves room for hybrids, phase shifter, and control circuits for a steering network and provides lower losses than an N×N Butler Matrix. Embodiments of the present invention provide orthogonality and circular symmetry. In contrast, a Rotman Lens has aberrations and no circular symmetry. Similarly, an order-N Butler Matrix has orthogonality, but not circular symmetry to feed a circular array. Furthermore, both a Rotman Lens and an order-N Butler Matrix need N matched meander lines to feed N elements. However, at least some embodiments of the present invention do not require N meander lines in principle.

Embodiments of the present invention correspond to a wireless device for radiation beamsteering. The wireless device includes a processor, a transmitter/receiver coupled to the processor, wherein the transmitter/receiver is configured to transmit signals and receive signals according to instructions from the processor; and an antenna array, coupled to the transmitter/receiver, wherein the transmitter/receiver comprises beamsteering circuitry and a sparse phase-mode feed coupling the beamsteering circuitry to the antenna array. The sparse phase-mode feed includes a Butler Matrix and radial waveguide configured as described elsewhere herein. The wireless device may be a wireless access point, wireless router, base station or component thereof, mobile user equipment or machine-to-machine device, or the like. The processor may be configured to direct operation of the beamsteering circuitry in accordance with user or program input indicative of a desired beam direction. Transmitted and/or received signals may be passed through the beamsteering circuitry, the sparse phase-mode feed and the antenna elements to and/or from the transmitter/receiver.

Figure 11:
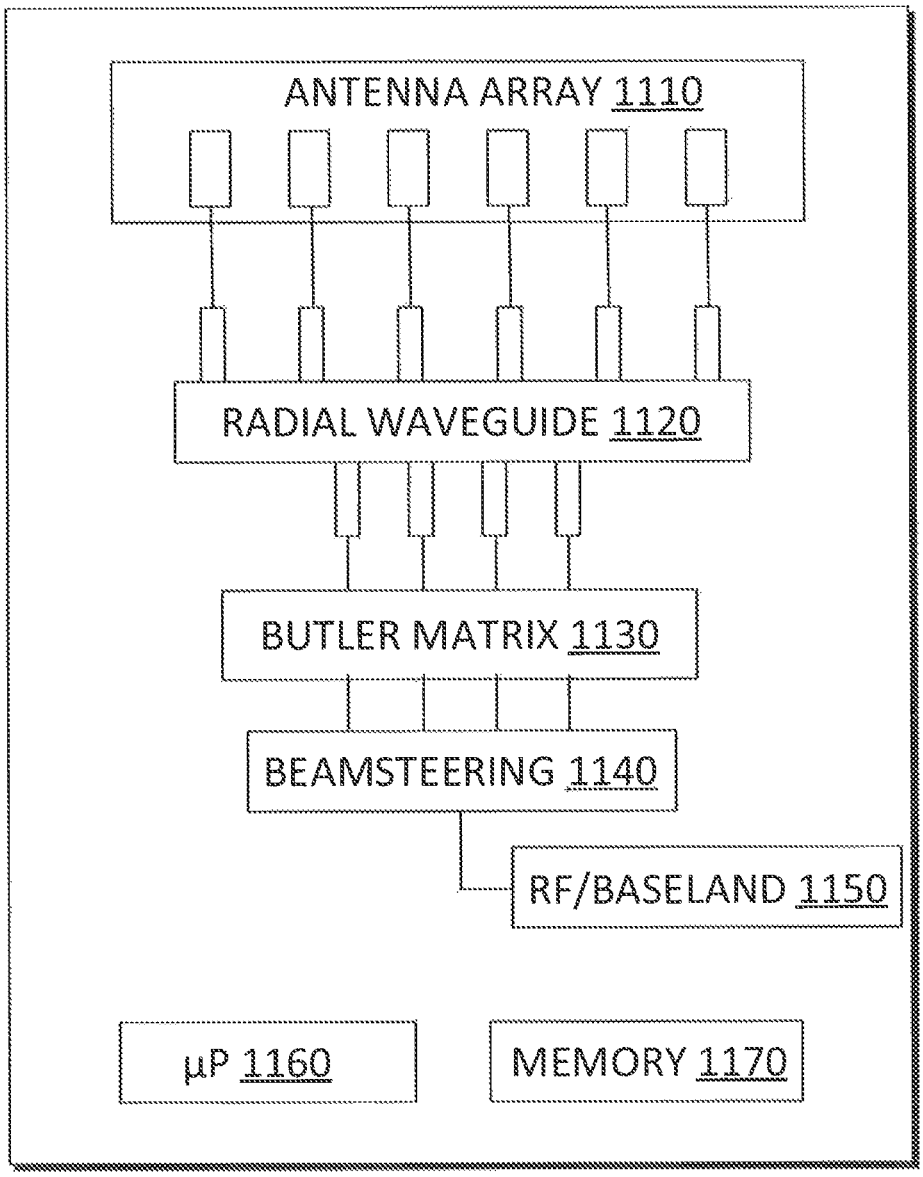
FIG. 11 illustrates a wireless device provided in accordance with an embodiment of the present invention.

FIG. 11 illustrates a wireless device provided in accordance with an embodiment of the present invention. Components are shown in side view. The wireless device includes a circular antenna array 1110, a radial waveguide 1120 coupled to the antenna array, a Butler Matrix 1130 coupled to the radial waveguide, and beamsteering circuitry 1140 coupled to the Butler Matrix. The wireless device further comprises a RF and/or Baseband electronics section 1150 which is operatively coupled to the beamsteering circuitry and provides signals thereto or receives signals therefrom. Signals may be provided or received from the RF and/or Baseband electronics section 1150 via signal ports internal or external to the device. A microprocessor 1160 operatively coupled to memory 1170 is also illustrated for example to provide for control of the wireless device. The wireless device utilizes the antenna array, as fed by the radial waveguide, Butler matrix and beamsteering circuitry, for communication.

Figure 12:
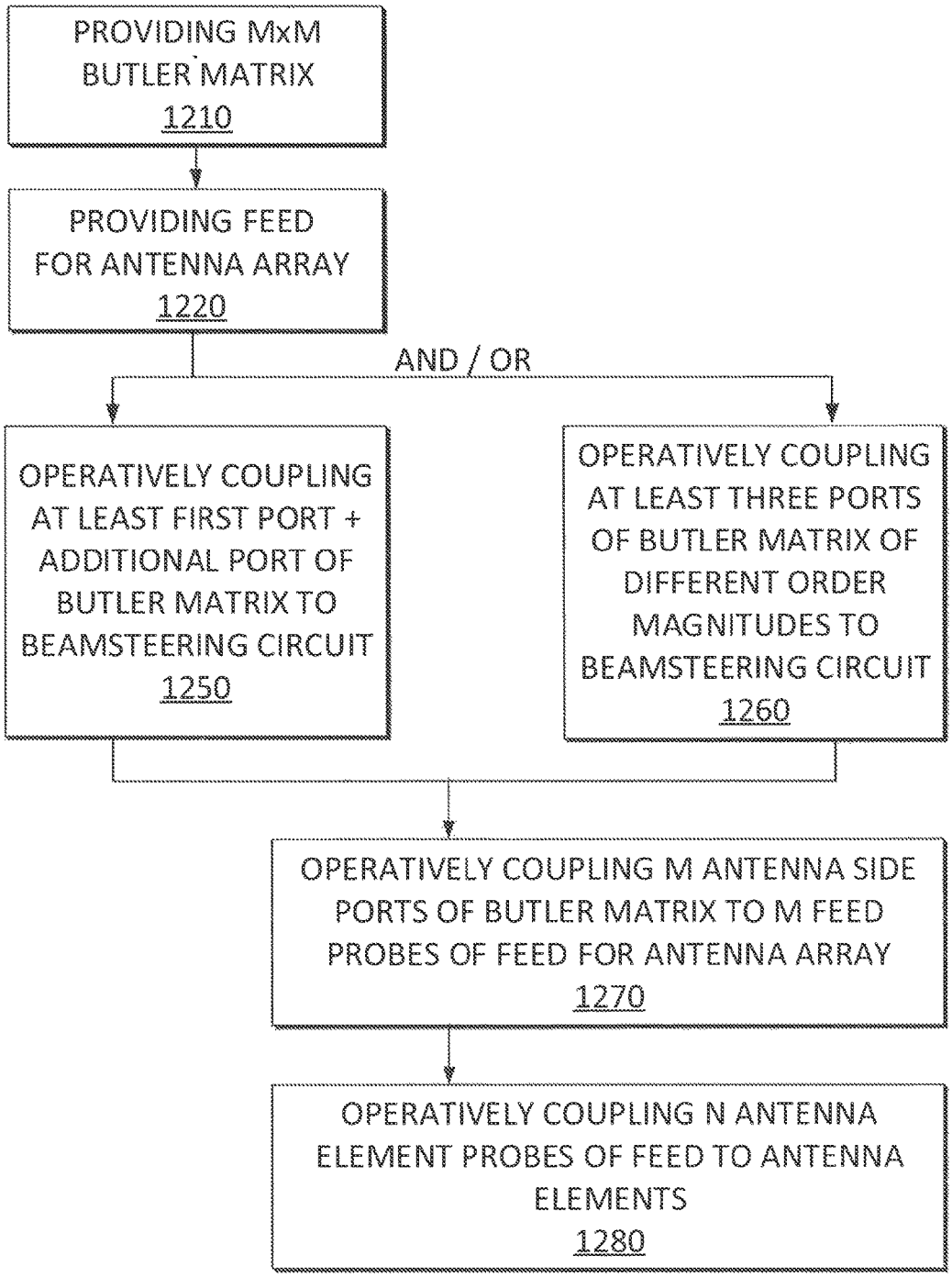
FIG. 12 illustrates a method sparse phase-mode feeding of an array of antenna elements, in accordance with an embodiment of the present invention.

FIG. 12 illustrates a method for sparse phase-mode feeding of an array of antenna elements, in accordance with an embodiment of the present invention. The method includes providing 1210 a Butler Matrix comprising a plurality of M antenna-side ports and a plurality of M input/output ports operatively coupled to the M antenna-side ports. The method further includes providing 1220 a feed for the array of antenna elements. The feed includes a radial waveguide forming a cylindrical cavity bounded by conductive material. The feed also includes a plurality of N antenna-element probes symmetrically arranged about an axial center of the radial waveguide. The feed also includes a plurality of M phase-mode feed probes symmetrically arranged about the axial center of the radial waveguide and disposed radially inward from the plurality of antenna-element probes. The plurality of antenna-element probes are operatively coupled to the radial waveguide, and the plurality of phase-mode feed probes are also operatively coupled to the radial waveguide. A quantity M of the phase-mode feed probes is less than a quantity N of the antenna-element probes.

In a first set of embodiments, the plurality of input/output ports includes a first port corresponding to a phase-mode of an order magnitude greater than one within the Butler Matrix, and additional ports corresponding to the zeroth-order and other orders of phase-modes. In such embodiments, the method may further include operatively coupling 1250 at least the first port and typically at least one additional input/output port to beamsteering circuitry. The first port may correspond to the phase-mode of maximal available order or another phase-mode.

In a second set of embodiments, the plurality of input/output ports includes three ports corresponding respectively to three lowest orders of phase-modes, including the zeroth-order phase-mode, and potentially including a second or higher order phase-mode. In such embodiments, the method may further include operatively coupling 1260 at least the three ports to beamsteering circuitry. More than three ports may be operatively coupled to the beamsteering circuitry. For example all M ports may be operatively coupled thereto, and selection of which ports are used at a given time may be performed by operation of switches or other circuitry. The first and second set of embodiments may overlap.

The method further includes operatively coupling 1270 the M antenna-side ports of the Butler Matrix to the plurality of M phase-mode feed probes. The method further includes operatively coupling 1280 the N antenna-element probes to respective antenna elements of the array.

Although the present invention has been described with reference to specific features and embodiments thereof, it is evident that various modifications and combinations can be made thereto without departing from the invention. The specification and drawings are, accordingly, to be regarded simply as an illustration of the invention as defined by the appended claims, and are contemplated to cover any and all modifications, variations, combinations or equivalents that fall within the scope of the present invention.

What is claimed is:

1. An apparatus for feeding an array of antenna elements, comprising:

a 2M-port Butler Matrix comprising a plurality of M antenna-side ports and a plurality of M input/output ports operatively coupled to the M antenna-side ports, the plurality of input/output ports including a first port corresponding to a phase-mode having an order magnitude greater than one, at least the first port and one additional one of the plurality of input/output ports configured for operative coupling to beamsteering circuitry; and a feed for the array of antenna elements comprising:

a radial waveguide forming a cylindrical cavity bounded by conductive material;

a plurality of N antenna-element probes symmetrically arranged about an axial center of the radial waveguide, the plurality of antenna-element probes operatively coupled to the radial waveguide; and a plurality of M phase-mode feed probes symmetrically arranged about the axial center of the radial waveguide and disposed radially inward from the plurality of antenna-element probes, the plurality of phase-mode feed probes operatively coupled to the radial waveguide, a quantity M of the phase-mode feed probes being less than a quantity N of the antenna-element probes, the plurality of M phase-mode feed probes being operatively coupled to the M antenna-side ports of the Butler Matrix, each of the N antenna-element probes for operatively coupling to a respective antenna element of the array, wherein the array of antenna elements are arranged about a main axis and are each configured to radiate with a radiation pattern having a main lobe directed primarily in an axial direction parallel to the main axis, wherein the feed is provided as a laminated planar structure, the antenna elements of the array comprise a planar ring or several concentric rings of antenna elements disposed overtop of the feed, and the Butler Matrix is provided in a planar circuit underneath the feed.

2. The apparatus of claim 1, wherein the feed for the array of antenna elements further comprises:

electrically conducting first and second surfaces;

an electrically conducting outer wall electrically coupling the first surface to the second surface; the first surface, the second surface, and the outer wall defining the cylindrical cavity;

wherein each of the plurality of antenna-element probes has a first antenna probe portion electrically coupled to the first surface and a second antenna probe portion that protrudes into the cylindrical cavity through a respective aperture in the first surface; and wherein each of the plurality of phase-mode feed probes has a first feed probe portion electrically connected to the second surface and a second feed probe portion that protrudes into the cylindrical cavity through a respective aperture in the second surface.

3. The apparatus of claim 1, wherein the quantity M of the phase-mode feed probes is equal to four and wherein the first port corresponds to a second order phase-mode and wherein a second port of the plurality of input/output ports is configured for operative coupling to the beamsteering circuitry, the second port corresponding to a zeroth-order phase-mode.

4. The apparatus of claim 3, further comprising a switch operable to selectably couple one of the first port and the second port to the beamsteering circuitry.

5. The apparatus of claim 3, further comprising a variable ratio combiner configured to couple the first port and the second port to a port of the beamsteering circuitry in a controllable signal ratio.

6. The apparatus of claim 3, wherein a third port of the plurality of input/output ports is configured for operative coupling to the beamsteering circuitry, the third port corresponding to a 1st order or −1st order phase-mode.

7. The apparatus of claim 1, wherein the quantity M of the phase-mode feed probes is equal to four and wherein the M input/output ports correspond to a zeroth order phase-mode, a $1^{st}$ order phase-mode, a $-1^{st}$ order phase-mode, and a second order phase-mode.

8. The apparatus of claim 1, further comprising coupling circuitry for controllably coupling three or more ports of the Butler Matrix to the beamsteering circuitry, said controllable coupling based on a desired beam angle of a radiation pattern of the array of antenna elements.

9. The apparatus of claim 8, wherein the beam angle is an angle φ which is relative to the main axis.

10. The apparatus of claim 1, further comprising coupling circuitry for controllably coupling the M ports of the Butler Matrix to the beamsteering circuitry, said controllable coupling based on a desired beam angle of a radiation pattern of the array of antenna elements.

11. The apparatus of claim 10, wherein the beamsteering circuitry comprises the coupling circuitry.

12. The apparatus of claim 10, wherein the coupling circuitry comprises switches for switchably coupling selected ones of the M ports to selected ports of the beamsteering circuitry.

13. The apparatus of claim 1, further comprising coupling circuitry for controllably coupling two of the plurality of input/output ports of the Butler Matrix to the beamsteering circuitry at a time, said two of the plurality of input/output ports having order magnitudes which differ by one.

14. The apparatus of claim 1, wherein the plurality of N antenna element probes are operatively coupled to N antenna elements of the array.

15. The apparatus of claim 14, wherein the antenna elements are disposed at substantially regular intervals about a circle centered on a main axis, and are configured having a radiation pattern directed in an axial direction parallel to the main axis.

16. The apparatus of claim 1, wherein some or all of the antenna-element probes and the phase-mode feed probes are magnetic loops.

17. A method for sparse phase-mode feeding of an array of antenna elements, the method comprising:

providing a Butler Matrix comprising a plurality of M antenna-side ports and a plurality of M input/output ports operatively coupled to the M antenna-side ports, the plurality of input/output ports including a first port corresponding to a phase-mode having an order magnitude greater than one, at least the first port and one additional one of the plurality of input/output ports configured for operative coupling to beamsteering circuitry;

providing a feed for the array of antenna elements comprising:

a radial waveguide forming a cylindrical cavity bounded by conductive material;

a plurality of N antenna-element probes symmetrically arranged about an axial center of the radial waveguide, the plurality of antenna-element probes operatively coupled to the radial waveguide; and a plurality of M phase-mode feed probes symmetrically arranged about the axial center of the radial waveguide and disposed radially inward from the plurality of antenna-element probes, the plurality of phase-mode feed probes operatively coupled to the radial waveguide, a quantity M of the phase-mode feed probes being less than a quantity N of the antenna-element probes, operatively coupling at least the first port to beamsteering circuitry;

operatively coupling the M antenna-side ports of the Butler Matrix to the plurality of M phase-mode feed probes; and operatively coupling the N antenna-element probes to respective antenna elements of the array, wherein the array of antenna elements are arranged about a main axis and are each configured to radiate with a radiation pattern having a main lobe directed primarily in an axial direction parallel to the main axis, wherein the feed is provided as a laminated planar structure, the antenna elements of the array comprise a planar ring or several concentric rings of antenna elements disposed overtop of the feed, and the Butler Matrix is provided in a planar circuit underneath the feed.

18. The method of claim 17, wherein some or all of the antenna-element probes and the phase-mode feed probes are magnetic loops.

19. The method of claim 17, wherein the feed for the array of antenna elements further comprises:

electrically conducting first and second surfaces;

an electrically conducting outer wall electrically coupling the first surface to the second surface; the first surface, the second surface, and the outer wall defining the cylindrical cavity;

wherein each of the plurality of antenna-element probes has a first antenna probe portion electrically coupled to the first surface and a second antenna probe portion that protrudes into the cylindrical cavity through a respective aperture in the first surface; and wherein each of the plurality of phase-mode feed probes has a first feed probe portion electrically connected to the second surface and a second feed probe portion that protrudes into the cylindrical cavity through a respective aperture in the second surface.

20. The method of claim 17, wherein the quantity M of the phase-mode feed probes is equal to four and wherein the first port corresponds to a second order phase-mode and wherein a second port of the plurality of input/output ports is configured for operative coupling to beamsteering circuitry, the second port corresponding to a zeroth-order phase-mode.

21. The method of claim 20, further comprising selectably coupling one of the first port and the second port to the beamsteering circuitry via a switch.

22. The method of claim 20, further comprising coupling the first port and the second port to a port of the beamsteering circuitry in a controllable signal ratio using a variable ratio combiner.

23. The method of claim 20, wherein a third port of the plurality of input/output ports is configured for operative coupling to the beamsteering circuitry, the third port corresponding to a 1st order or −1st order phase-mode.

24. The method of claim 17, wherein the quantity M of the phase-mode feed probes is equal to four and wherein the M input/output ports correspond to a zeroth order phase-mode, a $1^{st}$ order phase-mode, a $-1^{st}$ order phase-mode, and a second order phase-mode.

25. The method of claim 17, further comprising coupling circuitry for controllably coupling three or more ports of the Butler Matrix to the beamsteering circuitry, said controllable coupling based on a desired beam angle of a radiation pattern of the array of antenna elements.

26. The method of claim 25, wherein the beam angle is an angle φ which is relative to the main axis.

27. The method of claim 17, further comprising controllably coupling the M ports of the Butler Matrix to the beamsteering circuitry, said controllable coupling based on a desired beam angle of a radiation pattern of the array of antenna elements.

28. The method of claim 17, wherein the antenna elements are disposed at substantially regular intervals about a circle centered on a main axis, and are configured having a radiation pattern directed in an axial direction parallel to the main axis.

29. The method of claim 17, further comprising controllably coupling two of the plurality of input/output ports of the Butler Matrix to the beamsteering circuitry at a time, said two of the plurality of input/output ports having order magnitudes which differ by one.

30. A wireless device comprising:

an array of antenna elements;

a transmitter/receiver comprising:

a source or destination for wireless signals;

beamsteering circuitry operatively coupled to the source or destination for wireless signals;

a Butler Matrix comprising a plurality of M antenna-side ports and a plurality of M input/output ports operatively coupled to the M antenna-side ports, the plurality of input/output ports including a first port corresponding to a phase-mode having an order magnitude greater than one, at least the first port and one additional one of the plurality of input/output ports configured for operative coupling to the beamsteering circuitry; and a feed for the array of antenna elements comprising:

a radial waveguide forming a cylindrical cavity bounded by conductive material;

a plurality of N antenna-element probes symmetrically arranged about an axial center of the radial waveguide, the plurality of antenna-element probes operatively coupled to the radial waveguide; and a plurality of M phase-mode feed probes symmetrically arranged about the axial center of the radial waveguide and disposed radially inward from the plurality of antenna-element probes, the plurality of phase-mode feed probes operatively coupled to the radial waveguide, a quantity M of the phase-mode feed probes being less than a quantity N of the antenna-element probes, the plurality of M phase-mode feed probes being operatively coupled to the M antenna-side ports of the Butler Matrix, each of the N antenna-element probes for operative coupling to a respective antenna element of the array, wherein the array of antenna elements are arranged about a main axis and are each configured to radiate with a radiation pattern having a main lobe directed primarily in an axial direction parallel to the main axis, wherein the feed is provided as a laminated planar structure, the antenna elements of the array comprise a planar ring or several concentric rings of antenna elements disposed overtop of the feed, and the Butler Matrix is provided in a planar circuit underneath the feed.

* * * * *